US010100830B2

(12) United States Patent
Stenbeck et al.

(10) Patent No.: US 10,100,830 B2
(45) Date of Patent: Oct. 16, 2018

(54) PUMP, A HOMOGENIZER COMPRISING SAID PUMP AND A METHOD FOR PUMPING A LIQUID PRODUCT

(71) Applicant: Tetra Laval Holdings & Finance S.A., Pully (CH)

(72) Inventors: Johan Stenbeck, Malmö (SE); Isac Salman, Malmö (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 15/525,840

(22) PCT Filed: Nov. 17, 2015

(86) PCT No.: PCT/EP2015/076839

§ 371 (c)(1),
(2) Date: May 10, 2017

(87) PCT Pub. No.: WO2016/079127

PCT Pub. Date: May 26, 2016

(65) Prior Publication Data

US 2017/0370355 A1 Dec. 28, 2017

(30) Foreign Application Priority Data

Nov. 18, 2014 (SE) ..... 1451382

(51) Int. Cl.
*F04B 53/14* (2006.01)
*F04B 43/00* (2006.01)
(Continued)

(52) U.S. Cl.
CPC ..... *F04B 53/142* (2013.01); *F04B 43/009* (2013.01); *F04B 43/0054* (2013.01);
(Continued)

(58) Field of Classification Search
CPC ..... F04B 43/067; F04B 43/02; F04B 43/06–43/073; F04B 43/107–43/113;
(Continued)

(56) References Cited

U.S. PATENT DOCUMENTS 2,869,474 A 1/1959 Pleuger et al.
2,919,650 A * 1/1960 Wiggermann ..... F04B 43/0054 417/383

(Continued)

FOREIGN PATENT DOCUMENTS

CN 202326133 U 7/2012
DE 43 27 969 A1 3/1995

(Continued)

OTHER PUBLICATIONS

International Search Report for corresponding International Application No. PCT/EP2015/076839 dated Apr. 15, 2016.

(Continued)

*Primary Examiner* — Alexander Comley
(74) *Attorney, Agent, or Firm* — Renner Otto Boisselle & Sklar, LLP

(57) ABSTRACT

A membrane-based piston pump (400) is used for pumping a liquid product. The pump is provided with a device (426) for maintaining a pre-defined hydraulic fluid volume in the pump. The device includes an axle element (440) and a bushing element (432). A method for pumping a liquid product in a pump may use the membrane-based piston pump. A homogenizer may include the membrane-based piston pump.

18 Claims, 20 Drawing Sheets

(51) Int. Cl.
*F04B 43/067* (2006.01)
*F04B 43/073* (2006.01)
*F04B 1/18* (2006.01)

(52) U.S. Cl.
CPC ..... *F04B 43/067* (2013.01); *F04B 53/141* (2013.01); *F04B 1/182* (2013.01); *F04B 43/0081* (2013.01); *F04B 43/0733* (2013.01)

(58) Field of Classification Search
CPC ... F04B 7/04; F04B 9/10–9/103; F04B 9/105; F04B 43/0081–43/009
USPC ..... 417/383, 385–387, 395, 390, 490–491, 417/493
See application file for complete search history.

(56) References Cited

U.S. PATENT DOCUMENTS 4,749,342 A 6/1988 Fritsch
5,074,757 A * 12/1991 Horn ..... F04B 43/009 417/63
5,810,567 A 9/1998 Horn
2004/0228748 A1 11/2004 Lehrke et al.

FOREIGN PATENT DOCUMENTS

EP 0188730 A2 7/1986
JP 2003-328948 A 11/2003
WO WO 91/11616 A1 8/1991
WO WO 2014/095898 A1 6/2014

OTHER PUBLICATIONS

Swedish Office Action dated Aug. 4, 2015 for corresponding Swedish Application No. 1451382-4.

International Preliminary Report on Patentability for corresponding International Application No. PCT/EP2015/076839 dated Jun. 1, 2017.

* cited by examiner

PUMP, A HOMOGENIZER COMPRISING SAID PUMP AND A METHOD FOR PUMPING A LIQUID PRODUCT

FIELD OF THE INVENTION

The invention generally relates to the processing industry. More particularly, the invention relates to a membrane-based piston pump suitable for hygienic applications, such as food processing, cosmetic product processing or pharmaceutical product processing. The invention also relates to a homogenizer comprising said pump and a method for pumping a liquid product.

BACKGROUND OF THE INVENTION

Today it is well known to use homogenizers within the food processing industry. For instance, within the dairy industry homogenizers are used for dividing fat globules into minor parts in order to obtain a stable fat emulsion against gravity separation. In other words, by homogenizing milk one can avoid that a cream layer is formed on top of the milk product. Other reasons for homogenizing food products are to achieve a more appetizing colour, reduced sensitivity of fat oxidation, more full bodied flavor, improved mouthfeel and better stability of cultured milk products.

The homogenizer and the homogenizing process are further described in "Dairy Processing Handbook" published by Tetra Pak, hereby incorporated by reference.

Generally a homogenizer can be divided in two main parts, a pump forming a high pressure and a homogenizing device providing a gap through which the product is forced. Today, most often the pump is a piston pump with three to five pistons. The pump may be a double membrane diaphragm pump as described in the international publication WO2014/095898 by the applicant, hereby incorporated by reference. This type of pump is ideal for hygienic applications such as homogenizers, and utilizes a chamber formed between two membranes forming a seal between a liquid product, i.e. a hygienic side, and a hydraulic pressure source, i.e. a non-hygienic side. Such a pump is normally operated to increase the pressure from approximately 3 bar up to 250 bar during the course of each pump/suction stroke. The pressure in the pump chamber hus increases from a low pressure, such as 3 bar, to a high pressure, such as 250 bar in a periodical manner during operation. Even higher pressure may also be provided. Further to this, elevated temperatures up to 140° C. may be provided, especially if the pump is arranged adjacent to heat treatment equipment.

In order for a pump of the above kind to operate efficiently, smooth and with least wear it is important that the diaphragm stroke is synchronized with the piston stroke. The synchronization is made through balancing of the volume of hydraulic fluid, e.g. hydraulic oil, in the hydraulic system of the pump. An incorrect hydraulic fluid volume will lead to an unsynchronized relation between the motion of the diaphragm and the motion of the piston, which increases the risk of damage to the diaphragm due to collisions with the pump housing. If the hydraulic fluid volume is below a nominal value the diaphragm will, during a suction stroke, reach its rear turning point prior to the piston and as the piston continues backwards the diaphragm will collide with the rear wall of the diaphragm cavity in the pump housing. If the hydraulic fluid volume is instead above a nominal value the diaphragm will, during a pump stroke, reach its front turning point prior to the piston and as the piston continues forwards the diaphragm will collide with the front wall of the diaphragm cavity of the pump housing. The collisions lead not only to wear of the diaphragm, but also to unwanted vibrations and noise. Additionally, excess hydraulic fluid in the system will rapidly create a high pressure difference over the diaphragm, during the pump stroke, as the diaphragm reaches the front wall of the diaphragm cavity. This will cause fatigue to the diaphragm and considerably reduce its lifetime. In addition, if the hydraulic fluid volume is below or above the nominal value, the efficiency of the pump decreases, i.e. the volume of product being pumped per stroke will decrease.

One way of balancing the hydraulic fluid in a piston pump is to use valves, e.g. a release valve for releasing excess hydraulic fluid from the system and a replenishing valve for refilling hydraulic fluid if required. The valves are activated by the pressure level in the hydraulic system. However, valves have a physical reaction time. For example, if using a spring loaded, ball type as replenishing valve, the ball needs to be lifted from the valve seat and the spring needs to be compressed before the hydraulic fluid passage is open. These actions require mass to be accelerated, and after that the hydraulic fluid itself must be set in motion.

Another way of balancing the hydraulic fluid is to use a camshaft mechanism in order to refill hydraulic fluid and a release valve for excess fluid. Also in this case mass needs to be accelerated, and hence there is a reaction time to consider.

Therefore, at present, none of the above solutions have proven to be able to operate fast enough to be used for high speed applications. With high speed applications is meant applications in which the pump is to make more than one full stroke per second, e.g. operating at a frequency of about 2-4 Hz.

SUMMARY OF THE INVENTION

Accordingly, the present invention preferably seeks to mitigate, alleviate or eliminate the above-identified deficiency in the art and provide a solution in which a hydraulic fluid volume can be maintained, by instantly releasing or refilling hydraulic fluid, if the volume differs from its nominal value.

In a first aspect, the invention provides a membrane-based piston pump for pumping a liquid product. Said pump is provided with a device for maintaining a pre-defined hydraulic fluid volume in the pump. The device comprises a hydraulic fluid reservoir, a bushing element attached in a passage between a piston cavity and a membrane cavity. Said bushing element has a radial opening in fluid connection with the hydraulic fluid reservoir. The device is further provided with an axle element arranged such that a first axial end thereof is attached to a first membrane provided in the membrane cavity, and such that at least a portion of said axle element is journalled, and adapted for axial movement, in the bushing element. The axle element is provided with a first recess. If the first membrane is displaced beyond a first operational turning point, to a point at, or in close vicinity of, a first extreme point, the first recess of the axle element is adapted to come into fluid connection with the radial opening of the bushing element. If the first membrane is displaced beyond a second operational turning point, to a point between the second turning point and the second extreme point, the radial opening of the bushing element is adapted to come into fluid connection with the piston cavity or to come into fluid connection with a second recess provided in the axle element. Thereby, a fluid connection is created between the hydraulic fluid reservoir and the hydraulic fluid volume of the pump.

In one or more embodiments the first operational turning point and the first extreme point are suction stroke points, and the connection between the first recess of the axle element and the radial opening of the bushing element, at or in the vicinity of, the first extreme point, will allow a flow of hydraulic fluid from the hydraulic fluid reservoir to the hydraulic fluid volume of the pump.

In one or more embodiments the second operational turning point and the second extreme point are pump stroke points, and the connection between the radial opening of the bushing element and the piston cavity, or the connection between the radial opening of the bushing element and the second recess of the axle element, at a point between the second operational turning point and the second extreme point, will allow a flow of hydraulic fluid from the hydraulic fluid volume of the pump to the hydraulic fluid reservoir.

In one or more embodiments a first axial end of the bushing element ends in the membrane cavity, and a second axial end of the bushing element ends in the piston cavity.

In one or more embodiments the first recess is a cut extending on an outer surface of the axle element, and which cut is adapted to provide fluid connection between the radial opening of the bushing element and the membrane cavity, at or in the vicinity of, the first extreme point.

In one or more embodiments the second recess is a cut extending on an outer surface of the axle element, and which cut is adapted to assist in providing fluid connection between the radial opening of the bushing element and the piston cavity, at a point between the second operational turning point and the second extreme point.

In one or more embodiments the first recess is a first radial opening, and the axle element is provided with an axial channel extending from a second axial end of the axial element to the first radial opening of the axle element, connecting the first radial opening and the axial channel.

In one or more embodiments the second recess is a second radial opening in connection with the axial channel.

In one or more embodiments the first axial end of the axle element is attached to a centrally arranged reinforcement disc attached to the first membrane.

In one or more embodiments the pump is adapted to increase the pump pressure from approximately 3 bar up to approximately 250 bar and down to approximately 3 bar during the course of a pump stroke followed by a suction stroke. In one or more embodiments the pump is adapted to increase the pump pressure higher than 250 bar.

In one or more embodiments the bushing element and the axle element are made of a ceramic material.

In one or more embodiments the ceramic material comprises zirconium oxide.

In one or more embodiments the gap between an outer envelope surface of the axle element and an inner envelope surface of the bushing element is in the range of 1-15 micrometers.

In one or more embodiments a second membrane is interconnected to the first membrane by means of a rod, said rod providing an axial distance between the first and the second membranes, and forming a membrane interior space.

In one or more embodiments the membranes and the membrane interior space divide the membrane cavity into at least first and second membrane cavity portions, said first and second membrane cavity portions being sealed from each other, said first membrane cavity portion being adapted to receive the hydraulic fluid, and said second membrane cavity portion being adapted to receive a liquid product.

In one or more embodiments the first and second membranes are coaxially arranged, the rod is arranged at the centres of the membranes, and the rod is axially aligned with the axle element.

In one or more embodiments the bushing element comprises two bushings, and the radial opening of the bushing element is formed by a gap between the two bushings.

In one or more embodiments the first radial opening of the axle element comprises a radial, circumferential slot and hole, said hole connecting said slot with the axial channel.

In one or more embodiments one or more channels are provided between the membrane cavity and the piston cavity, said channels being adapted for passage of hydraulic fluid.

In a second aspect, the invention provides a homogenizer comprising a membrane-based piston pump according to claim 1.

In a third aspect, the invention provides a method for pumping a liquid product in a pump. Said pump comprises a hydraulic fluid reservoir and a bushing element attached in a passage between a piston cavity and a membrane cavity. Said bushing element has a radial opening in fluid connection with the hydraulic fluid reservoir. Said pump further comprises an axle element arranged such that a first axial end thereof is attached to a first membrane provided in the membrane cavity, and such that at least a portion of said axle element is journalled, and adapted for axial movement, in the bushing element. Said axle element is further provided with a first recess. The method comprises the step of filling a second membrane cavity portion, of the membrane cavity, with the liquid product by moving the first membrane to a first operational turning point. The method further comprises the step of emptying the liquid product from the second membrane cavity portion by moving the first membrane to a second operational turning point. The method further comprises the step of, if the first membrane is displaced beyond the first operational turning point, to a point at, or in close vicinity of, a first extreme point, creating a fluid connection between the hydraulic fluid reservoir and a hydraulic fluid volume of the pump for introducing hydraulic fluid into the pump by letting the first recess of the axle element come into fluid connection with the radial opening of the bushing element, and if the first membrane is displaced beyond a second operational turning point, to a point between the second operational turning point and a second extreme point, creating a fluid connection between the hydraulic fluid reservoir and the hydraulic fluid volume of the pump for discharging hydraulic fluid from the pump by providing fluid connection between the radial opening of the bushing element and the piston cavity or by providing fluid connection between the radial opening of the bushing element and a second recess provided in the axle element.

In a fourth aspect, the invention provides a membrane arrangement for use in a membrane-based piston pump, said membrane arrangement comprises a first membrane and a second membrane, wherein said first and second membranes are interconnected by means of a rod.

In one or more embodiments the first and second membranes are coaxially arranged, the rod provides an axial distance between the first and the second membranes, and a first end of the rod is attached to the a centre of the first membrane and a second end of the rod is attached to a centre of the second membrane.

All features described in connection with any aspect of the invention can be used with any other aspect of the invention.

BRIEF DESCRIPTION OF THE DRAWINGS

The invention will be further described with reference to preferred embodiments, as shown in the drawings in which.

DETAILED DESCRIPTION OF EMBODIMENTS

Figure 1:
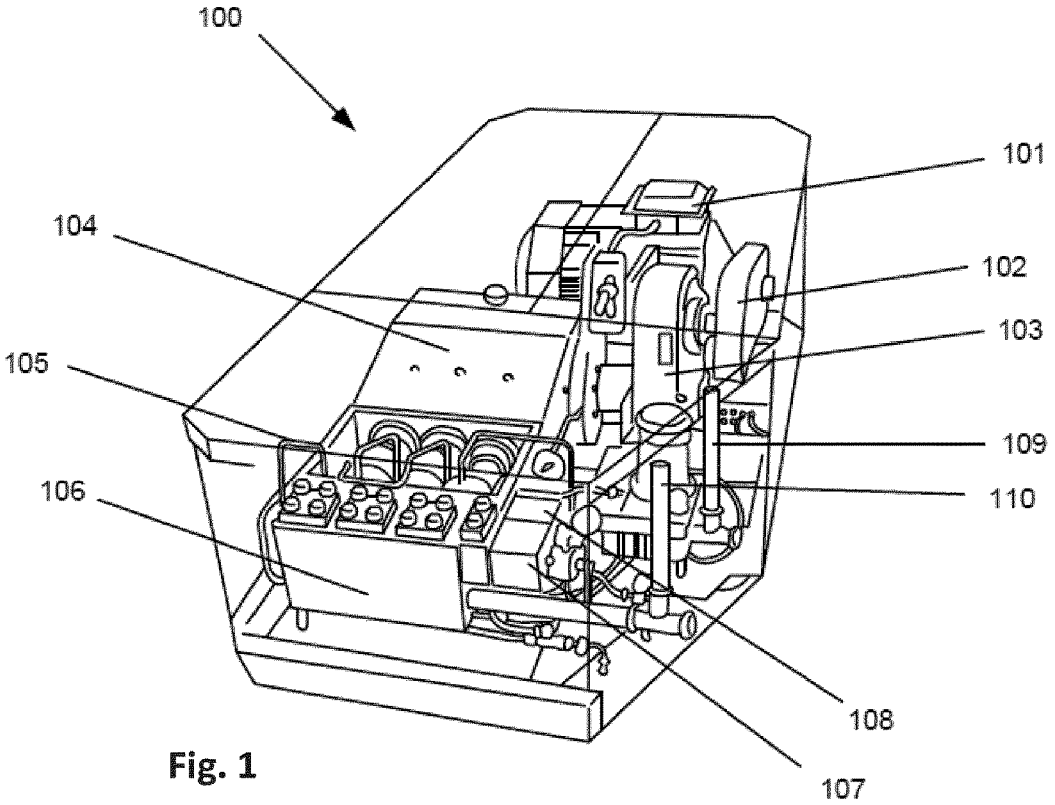
FIG. 1 shows a schematic view of a homogenizer in which the pump of the invention may be incorporated.

FIG. 1 generally illustrates a homogenizer 100, more particularly a homogenizer sold under the name Tetra Alex™ by Tetra Pak. Generally, the homogenizer 100 comprises two main parts, a pump and a homogenization device. The pump forms a high pressure and the homogenization device provides one or several gaps through which the product is forced with the effect that smaller fat globules are formed. Further effects of homogenization is more appetizing colour, reduced sensitivity to fat oxidation, more full-bodied flavour and better stability of cultured milk products.

In this example, the pump is a piston pump driven by a main drive motor 101 connected via a belt transmission 102 and a gearbox 103 to a crankshaft placed in a crankcase 104. By using the crankshaft the rotary motion is converted to a reciprocating motion driving pump pistons 105 back and forth. Today, it is common to have three to five pump pistons.

The pump pistons 105 run in cavities formed in a pump block 106 made to withstand the high pressure created by the pump pistons. Today it is common to increase the pressure from 300 kPa (3 bar) to about 10-25 MPa (100-250 bar), but higher pressures can be used as well.

Through cavities in the pump block 106 the product enters a first homogenizing device 107 and thereafter, in many cases, a second homogenizing device 108. As described above, by forcing the product through one or several gaps the properties of the product can be changed.

The reciprocating motion of the pump pistons 105 creates pulsations. To reduce the pulsations it is common practice today to place an inlet damper 109 on an inlet of the homogenizer. Further, in order to reduce vibrations and noise it is common practice to place an outlet damper 110 on an outlet.

Figure 2:
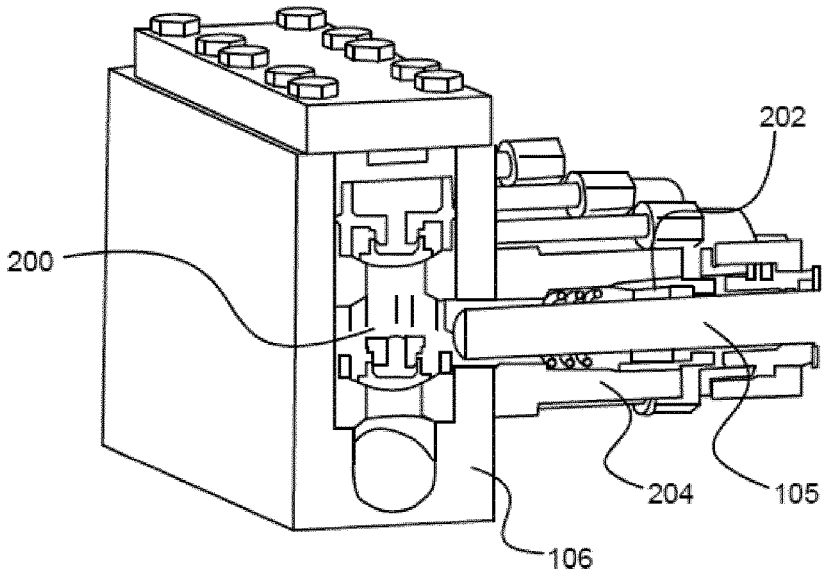
FIG. 2 shows a schematic view of a wet end of the homogenizer of FIG. 1.

FIG. 2 illustrates a so-called wet end of the homogenizer in greater detail. As can be seen in this cross sectional view, the piston 105 is moving back and forth such that a high pressure is formed in a product chamber 200 in the pump block 106. One or several seals 202 are used for keeping a tight fitting between the piston 105 and a piston receiving element 204. The one or several seals 202 also keep the product in the product chamber 200 apart from the crankcase and other non-hygienic parts of the homogenizer. In order to further make sure that unwanted microorganisms do not end up in the product it is a common approach today to use steam barriers or the like in combination with the piston seals 202.

Figure 3:
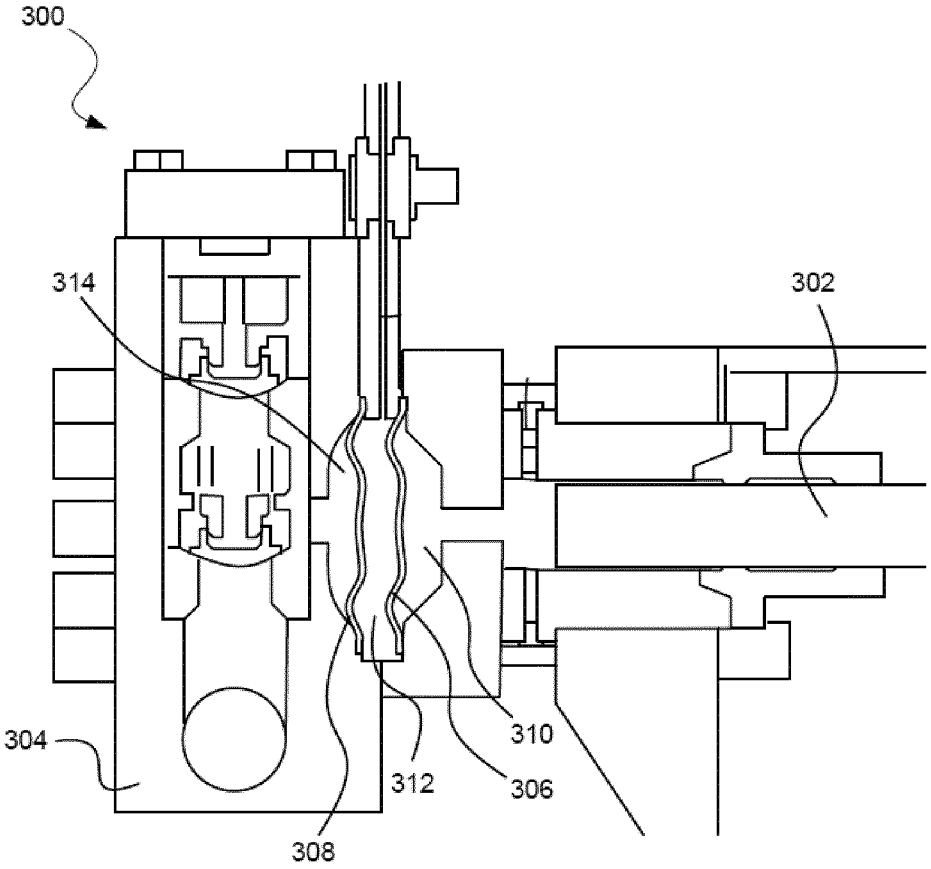
FIG. 3 shows a schematic view of a prior art membrane-based piston pump.

In FIG. 3 a prior art double membrane high pressure pump 300 is illustrated. The pump is provided with a piston 302, or more correctly a number of pistons, although only one of them is illustrated in this cross sectional view. Further, the piston 302 is forming a high pressure in a pump block 304, normally a pressure up to 250 bar.

In this high pressure pump a first membrane 306 and a second membrane 308 are provided. The first membrane 306 can be arranged such that a first membrane cavity 310, i.e. a hydraulic fluid chamber, and a membrane interior space 312, that is, a space formed between the first membrane 306 and the second membrane 308, is kept apart. The second membrane 308 can be arranged such that the membrane interior space 312 and a second membrane cavity 314, i.e. a product chamber, are kept apart.

The hydraulic fluid is preferably hydraulic oil. The reason for having hydraulic oil is that this is used for forwarding the pressure formed by the piston 302 via the first membrane 306 and the second membrane 308 to the product chamber 314, but also for lubricating the seals and in that way extend the life time of the seals. Hence, unlike the wet end illustrated in FIG. 2, the piston is indirectly forming a pressure in the product chamber 314.

An advantage of having membranes separating the product chamber 314 from the piston 302, crankshaft, crankcase and other parts placed on the non-hygienic side is that a well defined border is formed. An effect of this is that the risk that unwanted microorganisms pass the membranes into the product chamber 314 is significantly lowered. Even if the same degree of food safety may be achieved using for instance steam barriers, the membranes solution has the benefit that no steam barriers are needed. The effect of this in turn is that the operational costs for running the homogenizer can be significantly reduced. Also from an environmental perspective, using less steam is of significant value. Further details of the high pressure pump are described in the international publication WO2014/095898.

Figure 4:
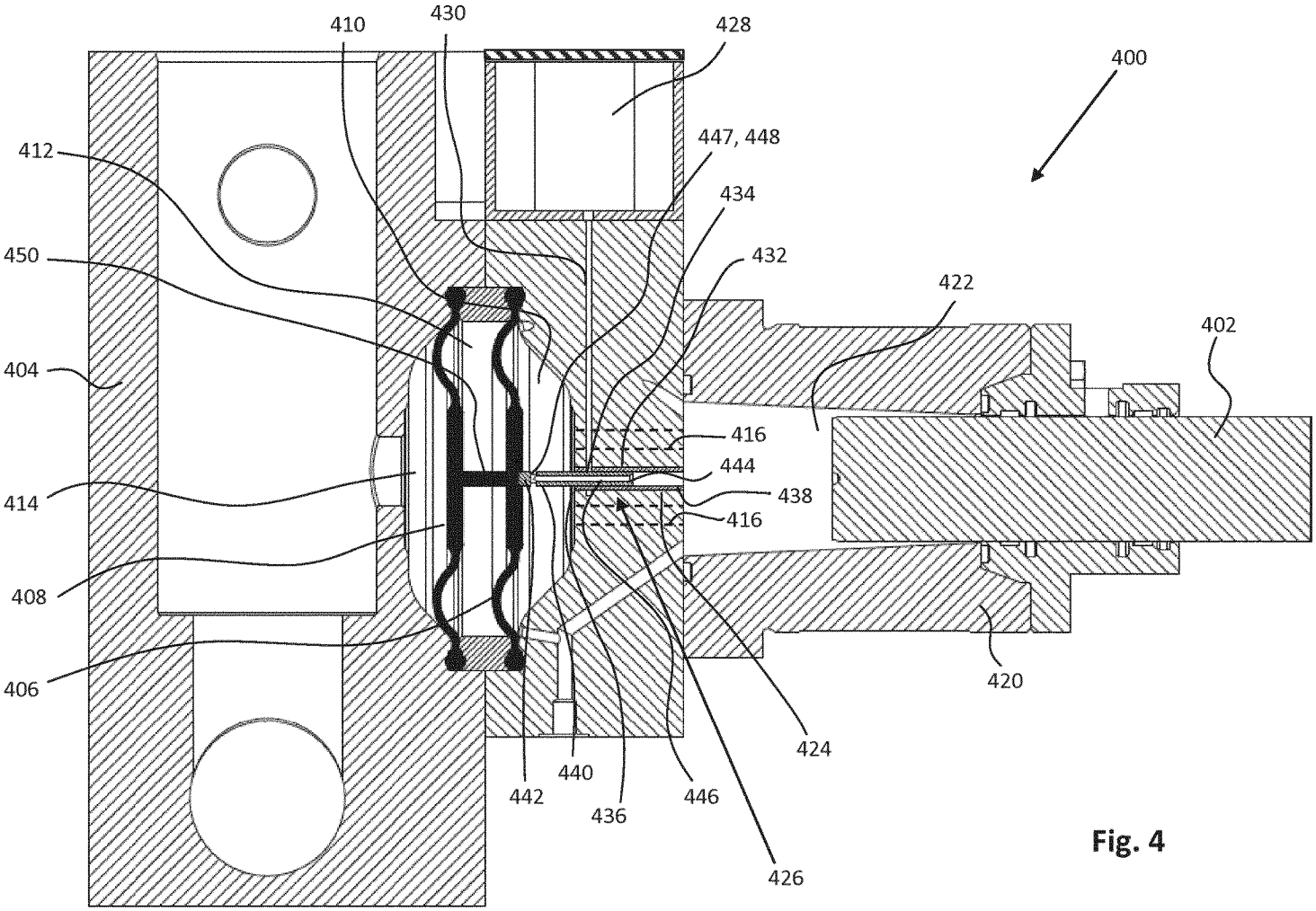
FIG. 4 shows a schematic view of a first embodiment of a membrane-based piston pump of the invention.

FIG. 4 shows a first embodiment of a membrane-based piston pump 400 according to the invention.

The pump 400 comprises a pump housing comprising a first pump block 404. Said pump block 404 comprises a membrane cavity. The membrane cavity comprises a first membrane cavity portion 410, a second membrane cavity portion 414 and a membrane interior space 412. The cavities are separated from each other by membranes. A first membrane 406 is provided between the first membrane cavity portion 410 and the membrane interior space 412. A second membrane 408 is separating the membrane interior space 412 and the second membrane cavity portion 414. The membranes 406, 408 are attached in any conventional manner. The pump housing is further provided with a second pump block 420, in the form of a cylinder bushing, attached to the first pump block 404. The second pump block 420 is provided with a piston cavity 422. The piston cavity 422 is adapted to receive at least a portion of a pump piston 402. The pump piston 402 is adapted to reciprocate in and out of the piston cavity 422, i.e. movement in left-right directions in the figure. The movement will change the volume of the piston cavity 422, and thereby change the pressure in the cavities.

One or several channels 416 are provided for hydraulic fluid communication between the piston cavity 422 and the membrane cavity. The channels 416 are shown with hidden lines in FIG. 4. The channels 416 have a total cross section large enough to let a major part of the hydraulic fluid volume quickly pass through from one cavity to the other during a piston stroke. The channels 416 end in the first membrane cavity portion 410.

Between the first membrane cavity portion 410 and the piston cavity 422 there is also provided a passage 424 for fluid communication there between.

The pump is further provided with a device 426 for maintaining a pre-defined hydraulic fluid volume in the pump. As described in relation to the previous figures, a hydraulic fluid, such as for example hydraulic oil, is held in the piston cavity 422 and the first membrane cavity portion 410, and is used for building up a pump pressure during a pump stroke of the piston 402. The device 426 comprises a hydraulic fluid reservoir 428. The reservoir is a tank arranged above the first pump block 404. The tank is closed and the pressure therein is either atmospheric, or slightly higher than atmospheric, for example equal or higher than the initial pump pressure to facilitate movement of the membranes and prevent hydraulic fluid from leaking back into the hydraulic fluid reservoir 728. The initial pump pressure is the pressure prevailing in the first membrane cavity portion and the piston cavity when the piston starts a pump stroke, i.e. moving from right to left in FIG. 4. The initial pump pressure is approximately in the range of 2-4 bar. In this embodiment the initial pump pressure is 3 bar.

In the first pump block 404 a hydraulic fluid channel 430 is provided. Said channel 430 extends between the bottom of the hydraulic fluid reservoir 428 and the passage 424, for fluid communication between the reservoir 428 and the passage 424.

The device 426 is further provided with a bushing element 432. In this embodiment the bushing element 432 is a single bushing, and will hereon, in this embodiment, be referred to as bushing 432. The bushing 432 is tightly fit to the passage 424. The length of the bushing 432 substantially equals the length of the passage 424, i.e. a first axial end 436 of the bushing 424 ends in the first membrane cavity portion 410, and a second axial end 438 of the bushing 424 ends in the piston cavity 422. The bushing 432 has the shape of a tube or an annular cylinder, and hence has an axial opening extending between the first axial end 436 and the second axial end 438.

The bushing 432 is preferably made of a ceramic material. For example, the bushing is made of a zirconium oxide-based material. One exemplary material of this kind is currently marketed under the registered trademark Frialit®. Alternatively, the bushing may be made by stainless steel or another metal.

The bushing 432 has a radial opening 434 overlapping the orifice of the hydraulic fluid channel 430 in the passage 424. The radial opening 434 extends through the wall of the bushing 432 and into the interior axial opening of the bushing.

The device 426 further comprises an axle element 440. The axle element 440 is arranged such that a first axial end 442 thereof is attached to the first membrane 406. At least a portion of said axle element 440, including a second axial end 444 thereof, is journalled, and adapted for axial movement, in the bushing 432. Hence, the radial cross section of the axle element 440 can slide tightly against the inner wall of the bushing 432. Still, it is inevitable that a small amount of hydraulic fluid will leak from one cavity to the other via the gap existing between an outer envelope surface of the axle element 440 and an inner envelope surface of the bushing 432. To minimize this leakage the gap is preferably kept small, preferably the gap is in the range of 1-15 micrometers (μm). In one or more preferred embodiments the gap is less than 10 micrometer. In one or more preferred embodiments the gap is in the range of 6-8 micrometers. In one or more embodiments the gap is in the range of 1-5 micrometers.

The axle element 440 is provided with an interior axial channel 446. The axial channel 446 extends along a majority of the axle element 440 and is adapted to provide fluid connection between the piston cavity 422 and the first membrane cavity portion 410 during a majority of the piston stroke.

Figure 7:
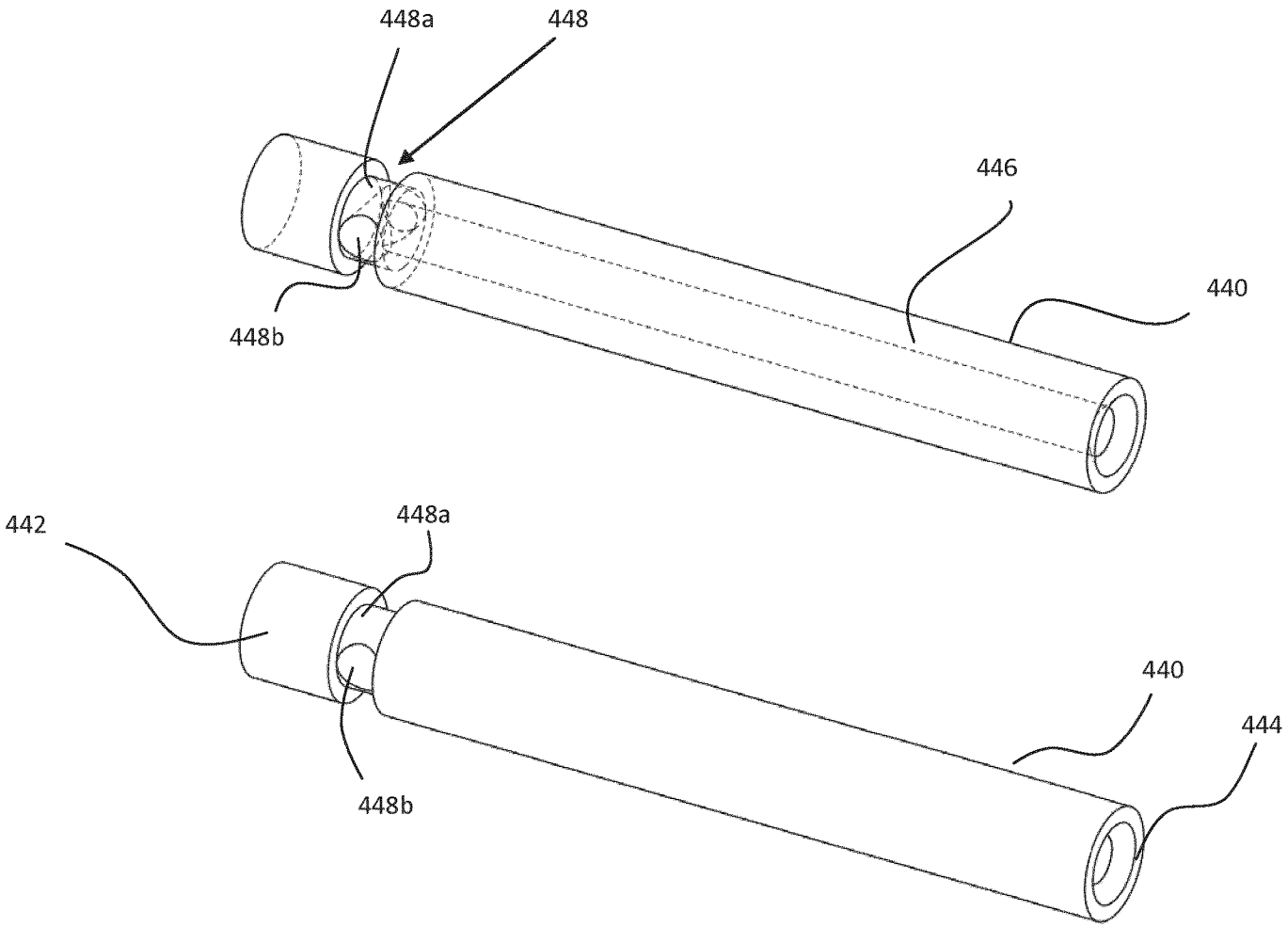
FIG. 7 shows first and second perspective views of the axle element of the first embodiment.
Figure 8:
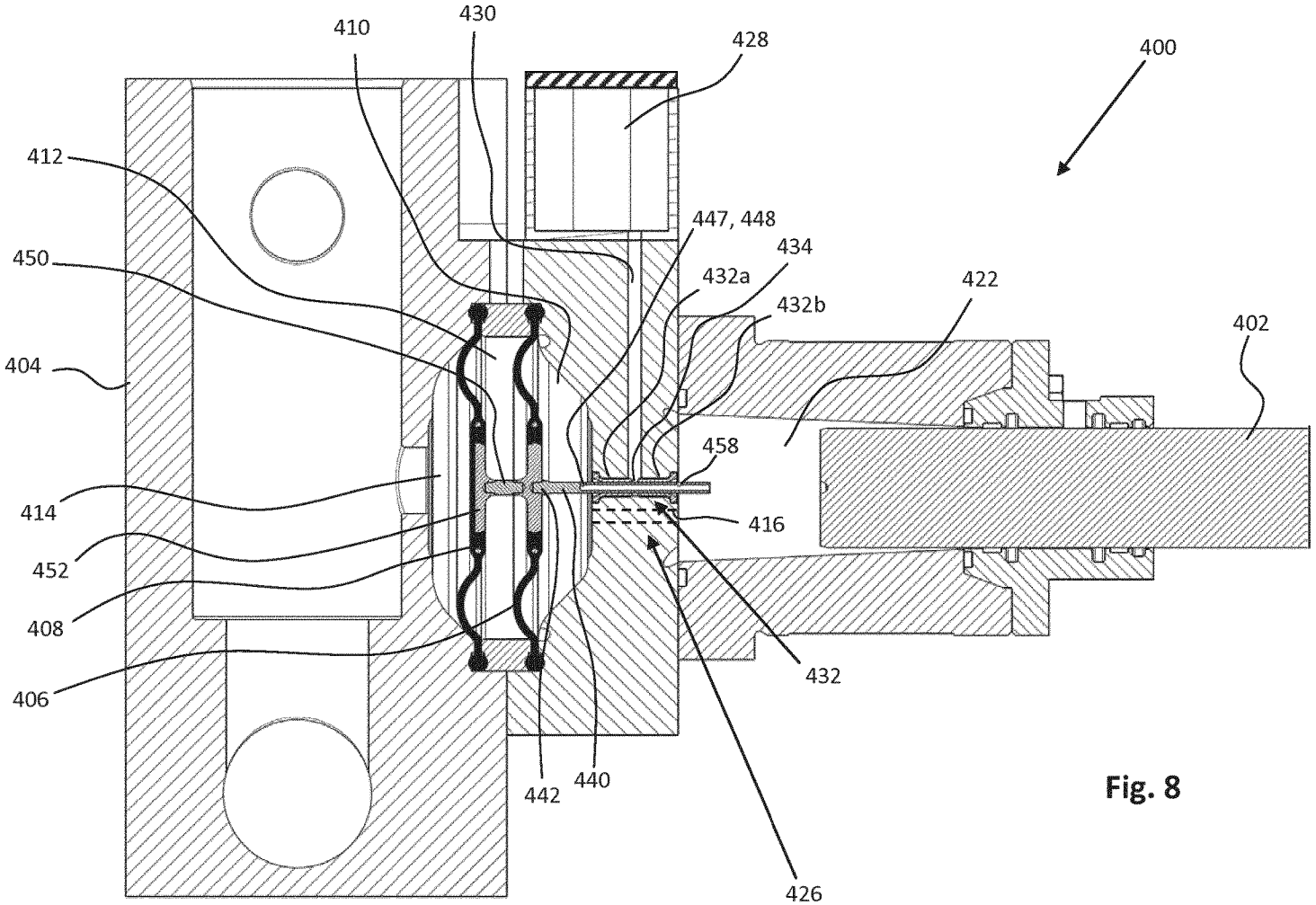
FIG. 8 shows a schematic view of a second embodiment of a membrane-based piston pump of the invention.

The first axial end 442 of the axle element 440 is preferably solid and to provide the above mentioned fluid connection the axle element 440 is provided with a first recess 447. In this embodiment the recess 447 is a first radial opening 448. The first radial opening 448 is provided in the end of the axial channel 446, in the vicinity of the solid first axial end 442 of the axle element. The axial channel 446 extends all the way to the second axial end 444 of axle element 440, and forms an orifice in the second axial end 444. The axle element 440 as such is shown in FIG. 7. The uppermost view shows the radial opening 448 and the axial channel 446 with hidden lines. The lowermost view shows the axial element without hidden lines. As can be seen from FIG. 7 the radial opening 448 is formed by a circumferential slot **448*a* and a through-going hole 448*b*, i.e. a hole radially passing through the axial channel 446. Alternatively, the radial opening 448 is formed by a similar circumferential slot and a hole extending into the axial channel 446, but not fully through the axle element 440**.

The axle element 440 is preferably made of a ceramic material. For example, the axle element is made of a zirconium oxide-based material. One exemplary material of this kind is currently marketed under the registered trademark Frialit®. Alternatively, the axle element may be made by stainless steel or another metal. The axle element 440 and the bushing 432 are preferably made of the same material.

The solid, first axial end 442 of the axle element 440 is attached to a centrally arranged reinforcement disc attached to the first membrane, see FIG. 4.

Figure 5:
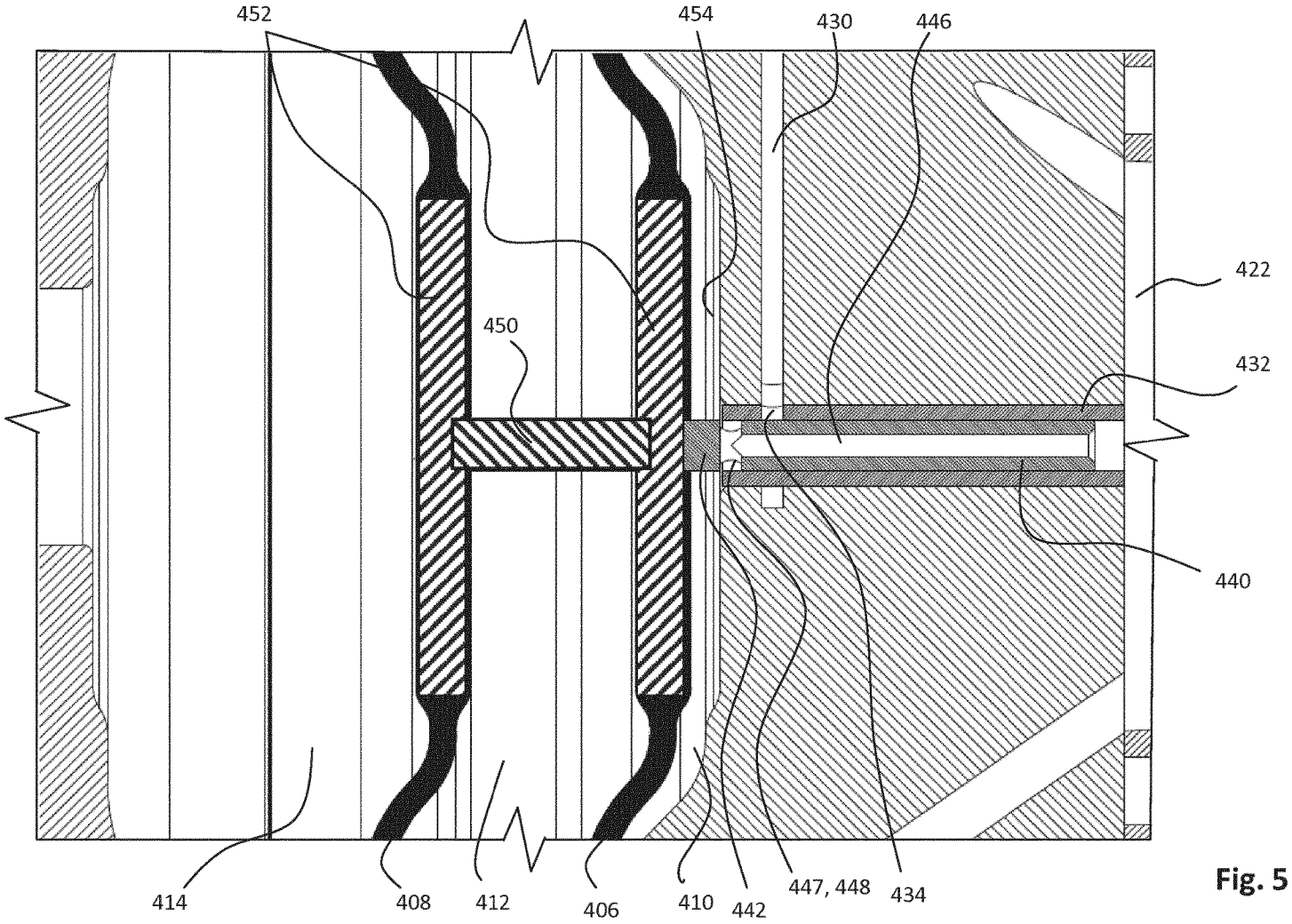
FIG. 5 shows a schematic, partial view of the first embodiment in a state where the membrane is at a first turning point.

FIG. 5 illustrates a first operational turning point of the first membrane. The radial opening 448 of the axle element 440 is arranged such that, at this point, it will be inside the bushing 432. However, at this point, it will be distanced from the radial opening 434 of the bushing 432. Further, at this point, the solid axial end 442 of the axle element 440 provides a distance between the reinforcement disc 452 of the first membrane 406 and a rear wall 454 of the membrane cavity. The distances are substantially equal. This gives that, if the reinforcement disc 452 of the first membrane 406 comes into contact with the rear wall 454, the radial opening 448 of the axle element 440 will substantially align with the radial opening 434 of the bushing 432.

Figure 6:
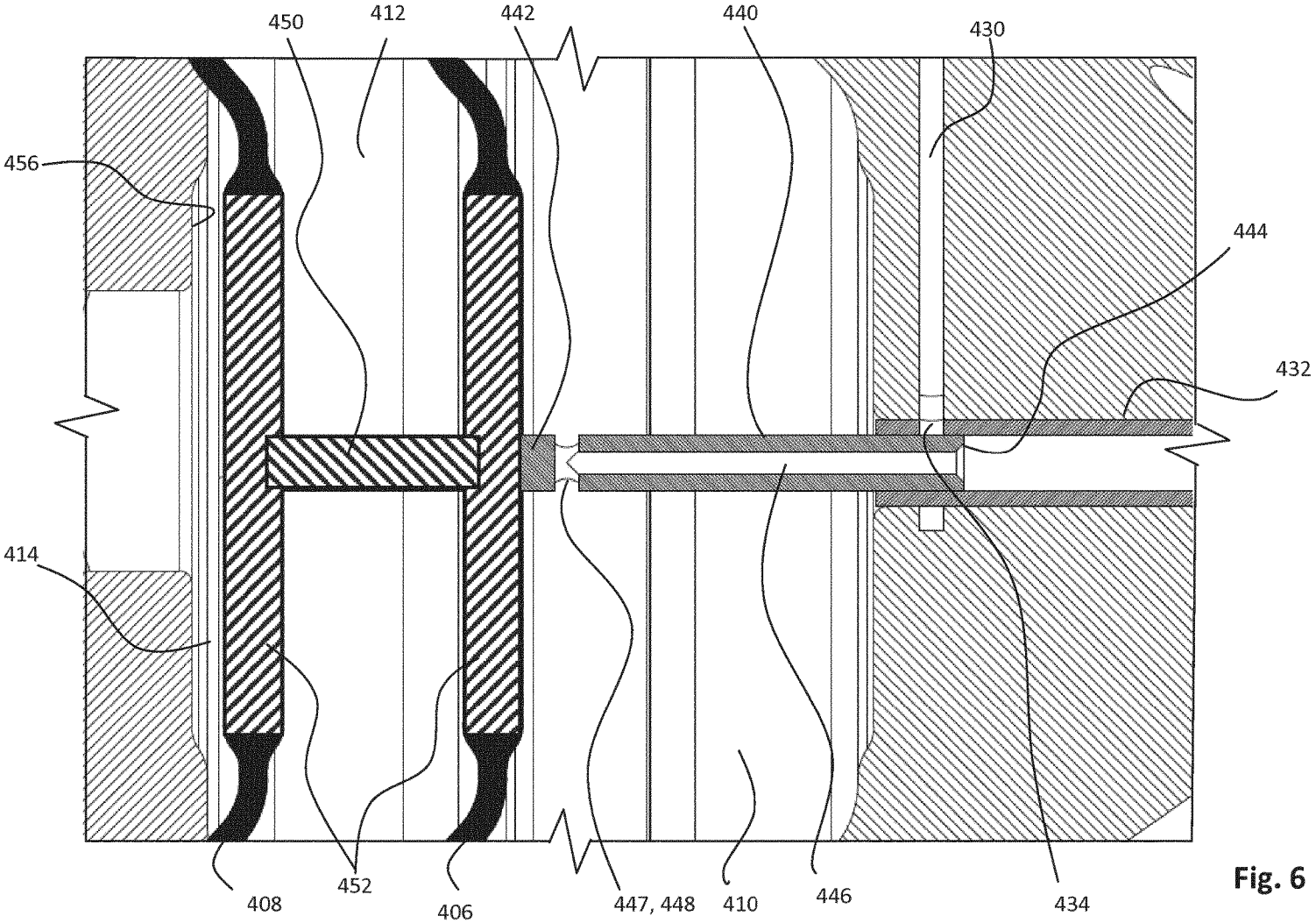
FIG. 6 shows a schematic, partial view of the first embodiment in a state where the membrane is at a second turning point.

FIG. 6 illustrates a second operational turning point of the first membrane 406. The length of the axle element 440 is such that the second axial end 444, at this point, will be distanced from the radial opening 434 of the bushing 432. The movement of the axle element 440, from the first operational turning point to the second operational turning point, in a direction from right to left in FIG. 6, will displace the second axial end 444 closer to the radial opening 434 of the bushing 432, but still a distance from it. At the second operational turning point the reinforcement disc 452 of the second membrane 408 will be positioned a distance from a front wall 456 of the membrane cavity. The distances are substantially equal. This gives that, if the reinforcement disc 452 of the second membrane comes into contact with the front wall 456 of the membrane cavity, the second axial end 444 of the axle element 440 will be at any position in between being substantially aligned with the radial opening 434 of the bushing 432, and having passed the radial opening 434 of the bushing 432.

Further, with reference to FIG. 4, the first and second membranes 406 and 408 are interconnected by means of a rod 450. Said rod 450 provides an axial distance between the first and the second membranes 406, 408, such that the membrane interior space 412 is formed therebetween. The first and second membranes 406, 408 are coaxially arranged. The rod 450 is arranged at the centres of the membranes 406, 408, and attached in an reinforcement disc 452 of the first membrane 406 and a similar reinforcement disc 452 attached to the second membrane 408. Further, the rod 450 is axially aligned with the axle element 440. The membranes are conventionally made of a flexible material such as for example rubber, for example EPDM rubber (ethylene propylene diene monomer rubber) or a rubber marketed under the trademark Fluoroprene®. The reinforcement discs and the rod are made of stainless steel or another more rigid material.

Figure 12:
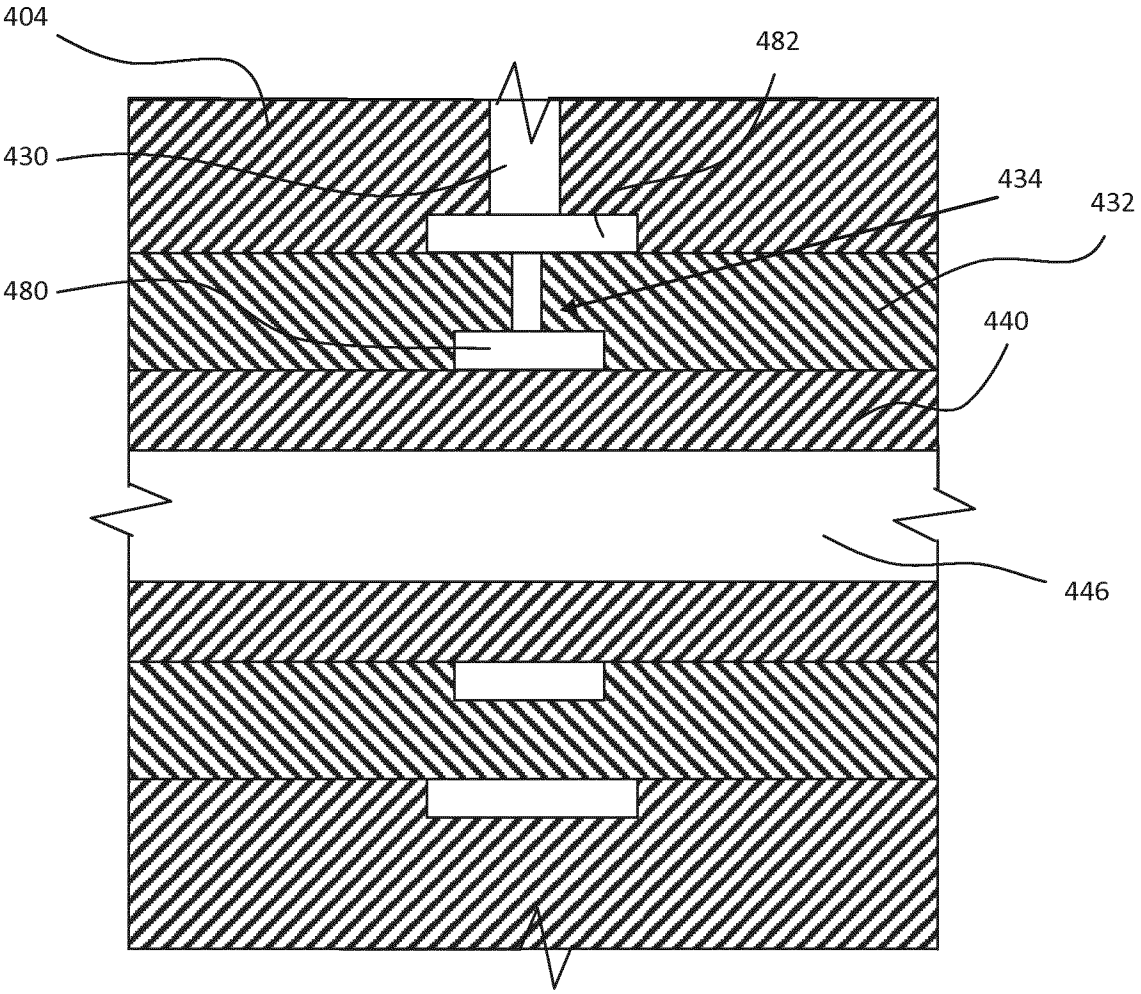
FIG. 12 shows a schematic view of a bushing, pump block and axle element according to an alternative embodiment.

FIG. 12 shows alternative designs of the radial opening 434 of the bushing 432 and the end of the hydraulic fluid channel 430. The radial opening 434 is here provided with a radial, circumferential slot 480 facing the axle element 440. By having the slot 480 the assembling is facilitated, such that no perfect alignment needs to be achieved between the radial openings (not shown in FIG. 12) of the axle element 440 and the bushing element 432. Similarly, a radial, circumferential slot 482 can be added in the end of the hydraulic fluid channel 430. The slot 482 is facing the outer envelope surface of the bushing 432. In this way mounting of the bushing into the passage 424 can be facilitated, such that no perfect alignment needs to be achieved between the hydraulic fluid channel and the radial opening 434 of the bushing 432.

In the following, and with reference to FIGS. 4-6, the pumping function and the function of the device for maintaining a constant hydraulic fluid volume will be described.

The pump 400 is used for pumping a liquid product, and the piston 402 (shown in FIG. 4) performs a suction stroke followed by a pump stroke. During the strokes the first and second membranes move in the membrane cavity. At normal operation the membrane movement is synchronous with the piston stroke and the hydraulic fluid volume within the pump is substantially constant, i.e. stays at its nominal, pre-defined value. In this state the membranes move between a first operational turning point near the rear wall 454 of the membrane cavity and a second operational turning point near the front wall 456 of the membrane cavity. FIG. 5 shows the positions of the membranes and the axle element at the first operational turning point, and FIG. 6 shows the positions of the membranes and the axle element at the second operational turning point.

During the suction stroke the piston is displaced in a direction from left to right in FIG. 4. As the volume of the piston cavity increases, the hydraulic fluid is forced through the channels and through the axle element towards the piston cavity. The pressure in the first membrane cavity portion drops, and the first and second membranes 406, 408 are moved towards a first operational turning point near the rear wall 454 of the membrane cavity. Simultaneously, the liquid product is filled into, and gradually expands, the second membrane cavity portion 414. The volume of the membrane interior space 412 stays constant. When a normal suction stroke is completed the membranes have reached the first operational turning point of FIG. 5, and the second membrane cavity portion has reached its largest volume.

During the subsequent pump stroke the piston is displaced in a direction from right to left in FIG. 4. As the volume in the piston cavity decreases, the hydraulic fluid is forced into the first membrane cavity portion via the channels and through the axle element. The pressure in the first membrane cavity portion increases and the membranes are moved towards a second operational turning point near the front wall 456 of the membrane cavity. Simultaneously, the liquid product is emptied out of the second membrane cavity portion. When a normal pump stroke is completed the membranes have reached the second operational turning point of FIG. 6, and the first membrane cavity portion has reached its largest volume.

If the hydraulic fluid volume of the pump deviates from its nominal value the membrane movement will no longer stay within the operational turning points. If the value is less than the nominal value, i.e. if there is too little hydraulic fluid in the pump, the membranes will be displaced beyond the first turning point, towards a first extreme point. If the value is instead higher than the nominal value, i.e. there is too much hydraulic fluid in the pump, the membranes will be displaced beyond the second turning point, towards a second extreme point. In both cases the device for maintaining a pre-defined hydraulic fluid volume will automatically adjust the hydraulic fluid volume back to its nominal, or pre-defined, value.

If the first membrane 406 is displaced beyond the first operational turning point, to a point at, or in close vicinity of, the first extreme point, a fluid connection will be created between the hydraulic fluid reservoir 428 and the hydraulic fluid volume of the pump 400. The fluid connection will introduce hydraulic fluid into the pump such that the pre-defined volume is again reached. When the membranes reach the first extreme point the reinforcement disc 452 of the first membrane 406 will come into contact with the rear wall 454 of the membrane cavity. When that happens, or shortly before that happens, the first radial opening 448 of the axle element 440 will become at least partly aligned with the radial opening 434 of the bushing element 432. Hence, a fluid passage will open between the first radial opening 448 and the radial opening 434 at the first extreme point or in a close vicinity of the first extreme point. When fluid connection has been established hydraulic fluid can flow from the hydraulic fluid reservoir 428, through the radial opening 434 of the bushing 432, through the radial opening 448 of the axle element 440 and into the piston cavity 422, such that the hydraulic fluid volume is again at its pre-defined volume. If the hydraulic fluid reservoir 428 is held at atmospheric pressure the membrane will have to reach the first extreme point, i.e. come into contact with the rear wall 454, before the pressure is lowered enough for any hydraulic fluid to flow. If the hydraulic fluid reservoir 428 is held at a pressure equal or higher than the initial pump pressure, the membrane does not need to come to the extreme point, i.e. contact the rear wall 454, but to a point in the vicinity of the extreme point.

If the first membrane 406 is displaced beyond the second operational turning point, to a point between the second operational turning point and the second extreme point, a fluid connection will be created between the hydraulic fluid reservoir 428 and the hydraulic fluid volume of the pump. The fluid connection will discharge any superfluous hydraulic fluid from the pump such that the pre-defined volume is again reached. When the membranes reach the first extreme point the reinforcement disc 452 of the second membrane 408 will come into contact with the front wall 456 of the membrane cavity. Preferably before that happens fluid connection will be established between the radial opening 434 of the bushing element 432 and the piston cavity 422. At a point between the second operational turning point and the second extreme point the second axial end 444 of the axle element 440 will, partly or fully, have passed the radial opening 434 of the bushing 432, such that the radial opening 434 of the bushing 432 is no longer closed by the axle element 440. Hence, hydraulic fluid can flow from the piston cavity 422, into the radial opening 434 of the bushing 432 and to the hydraulic fluid reservoir 428, such that the hydraulic fluid volume is again at its pre-defined volume.

A second embodiment of the membrane-based pump of the invention will now be described in relation to FIGS. 8-11. Only the differences from the first embodiment will be described. There are two main differences.

Figure 11:
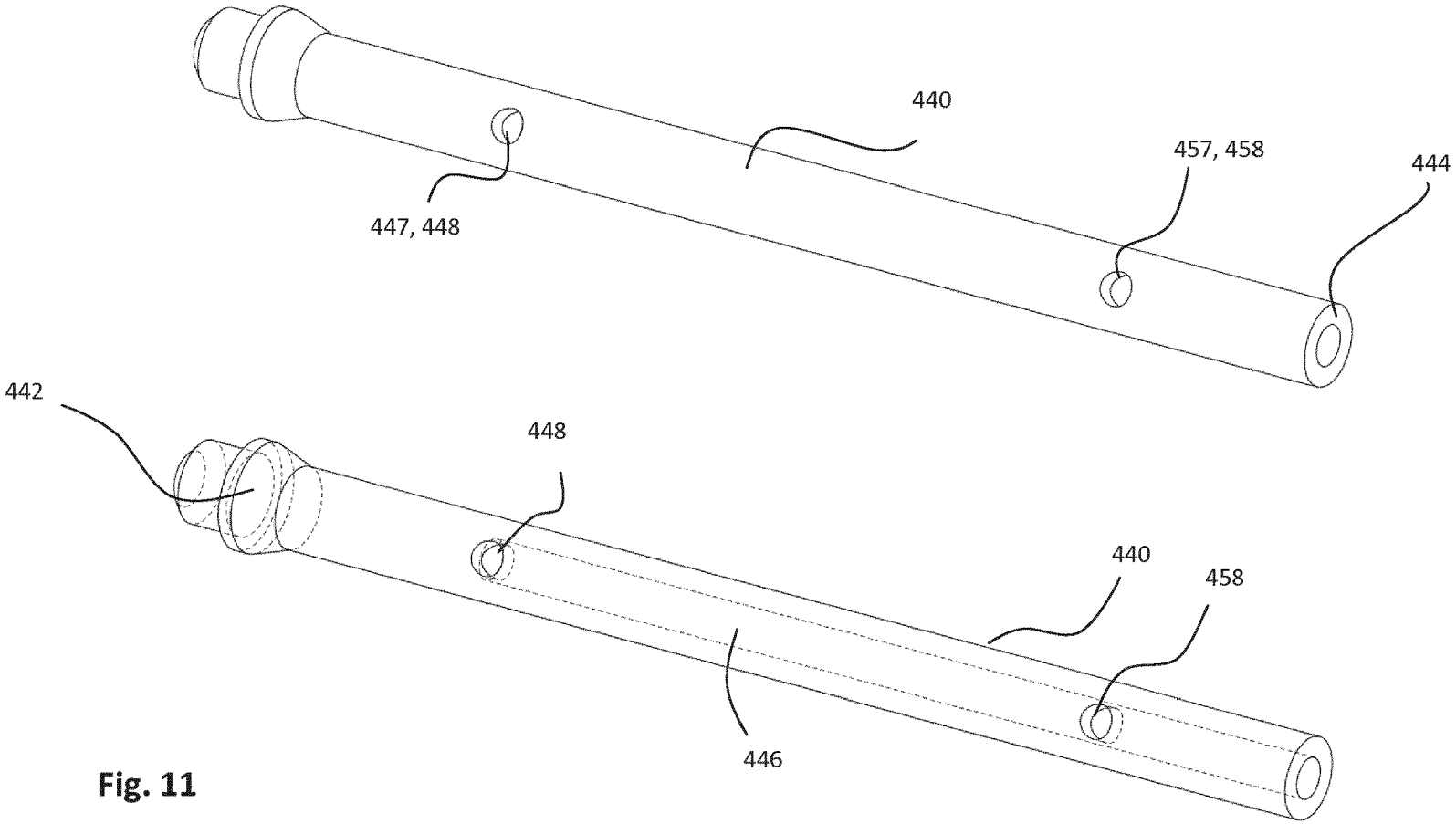
FIG. 11 shows first and second perspective views of the axle element of the second embodiment.

The first difference is that the axle element is provided with a second recess 457. In this embodiment the recess 457 is a second radial opening 458, in addition to the first radial opening 448. As can be seen in FIG. 11 the two radial openings 448, 458 are distanced from each other, but both extending into the axial channel 446 of the axle element 440.

The second difference is the bushing element 432. In this second embodiment the bushing element 432 comprises two bushings 432*a*, 432*b*. The radial opening 434 of the bushing element 432 is formed by an axial gap between the two bushings 432*a*, 432*b*.

Figure 9:
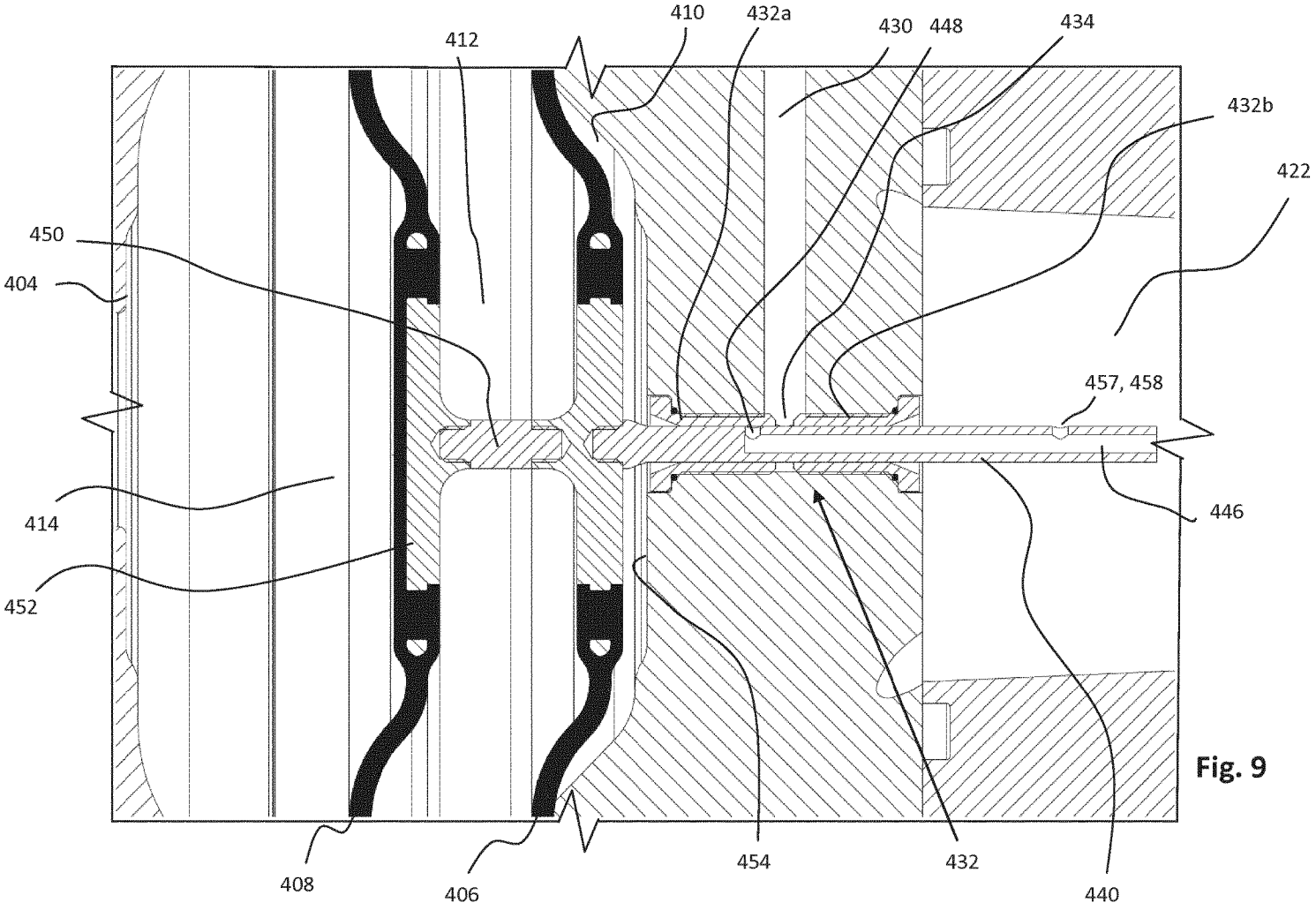
FIG. 9 shows a schematic, partial view of the second embodiment in a state where the membrane is at a first turning point.

At the first operational turning point, see FIG. 9, the first radial opening 448 of the axle element 440 is close to the radial opening 434 between the bushings 432*a*, 432*b*. If the axle element 440 is moved further, to a point close to the first extreme point, the first radial opening 448 of the axle element 440 will overlap with the radial opening 434 between the bushings 432*a*, 432*b*.

Figure 10:
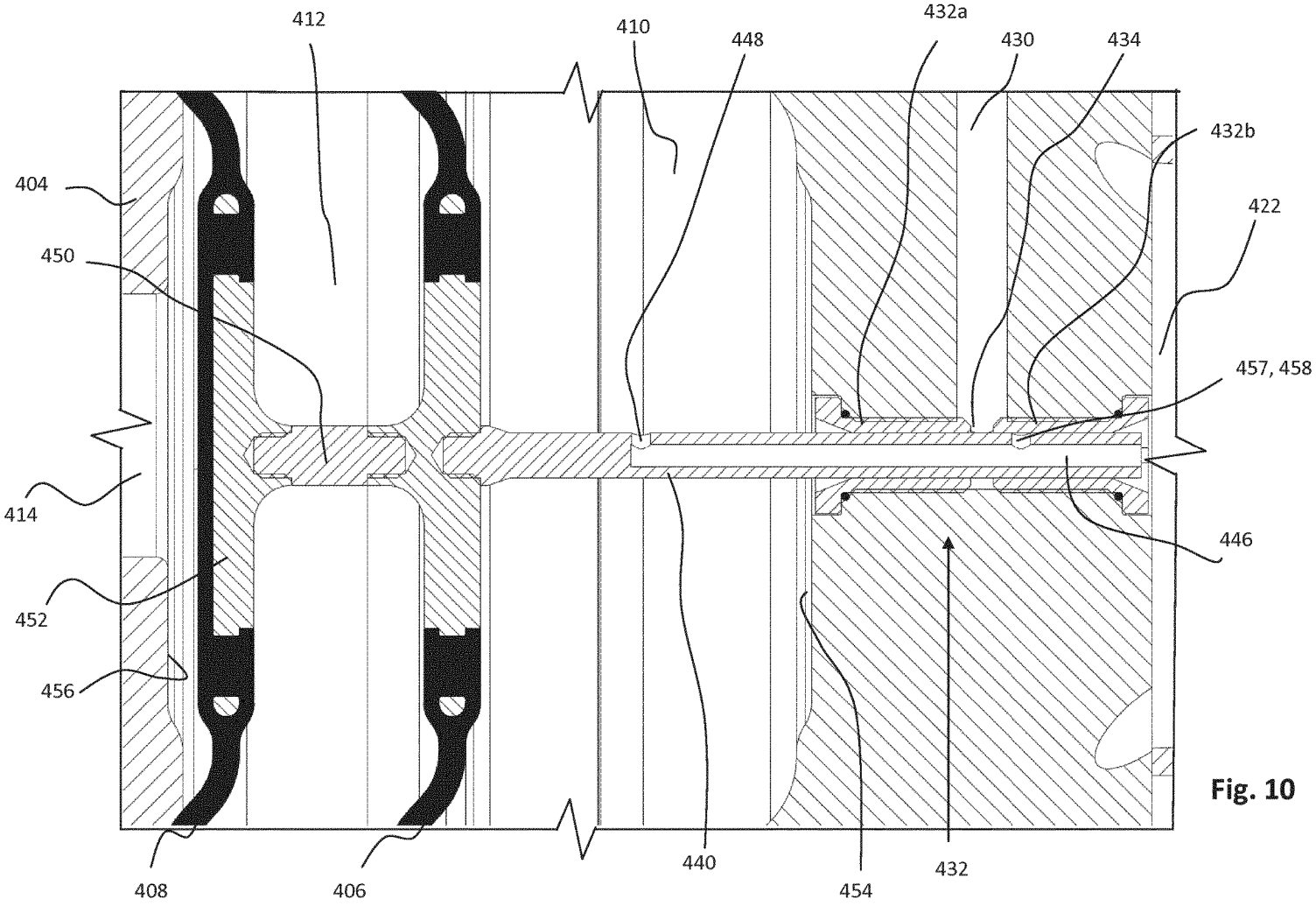
FIG. 10 shows a schematic, partial view of the second embodiment in a state where the membrane is at a second turning point.

At the second operational turning point, see FIG. 10, the second radial opening 458 of the axle element 440 is close to the radial opening 434 between the bushings 432*a*, 432*b*. At a point between the second operational turning point and the second extreme point, the second radial opening 458 of the axle element 440 will overlap with the radial opening 434 between the bushings 432*a*, 432*b*.

Figure 14:
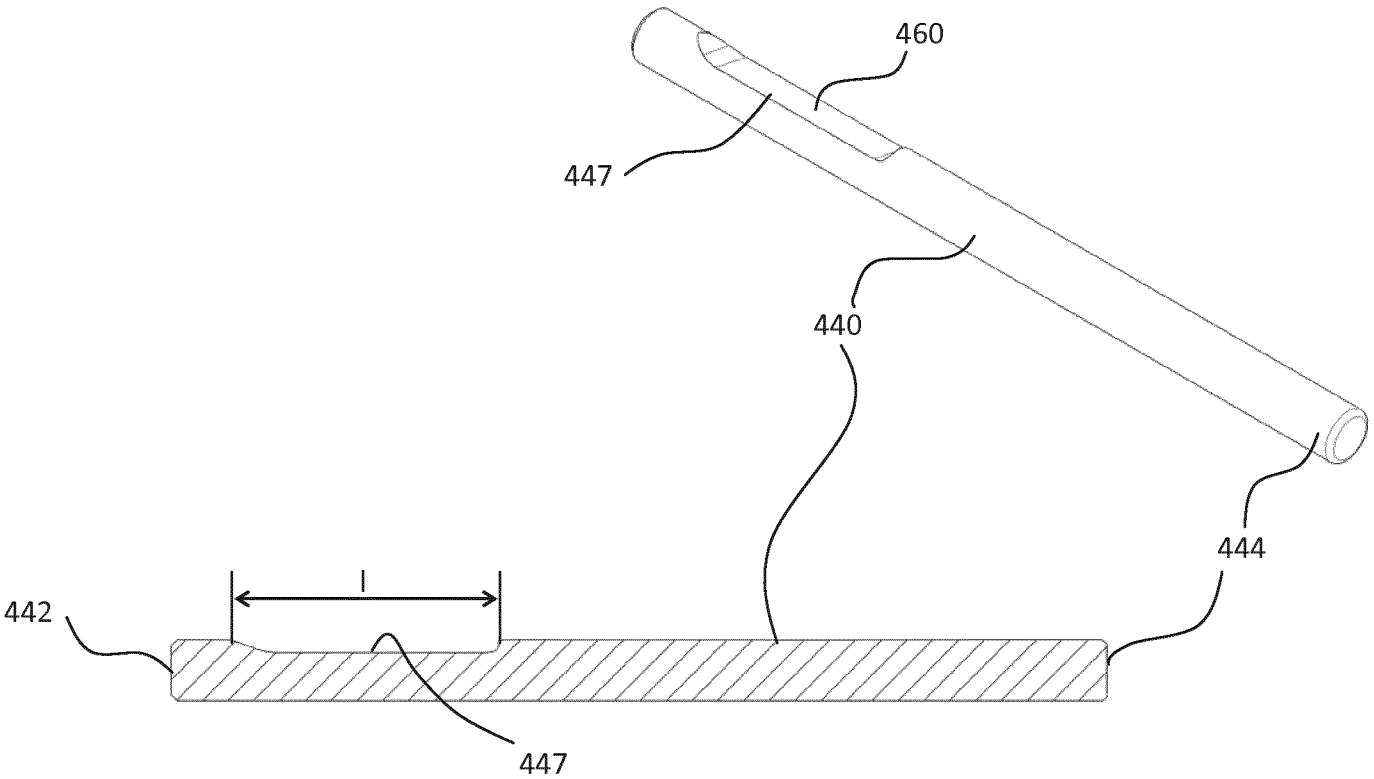
FIG. 14 shows a schematic perspective view and a schematic cross sectional view of the axle element of a third embodiment.

FIG. 14 shows two views of an axle element according to a third embodiment. Only the differences with regard to the previously described embodiments will be described in detailed, and the reference numerals will be the same for like elements.

The axle element 440 is in this third embodiment solid, i.e. it is not provided with an axial channel. Instead it is provided with a first recess 447 in the shape of a cut-out or an indentation along a portion of the outer perimeter of the axle element. The first recess 447 extends over a length 1 and is provided closer to the first axial end 442 than the second axial end 444. The recess 447 has a flat main surface 460 in a plane extending parallel to a centre axis of the axle element. The end of the recess on the left hand side (as seen in the cross sectional view of FIG. 14) is chamfered, whereas the end of the recess on the right hand side has a radius.

Figure 15:
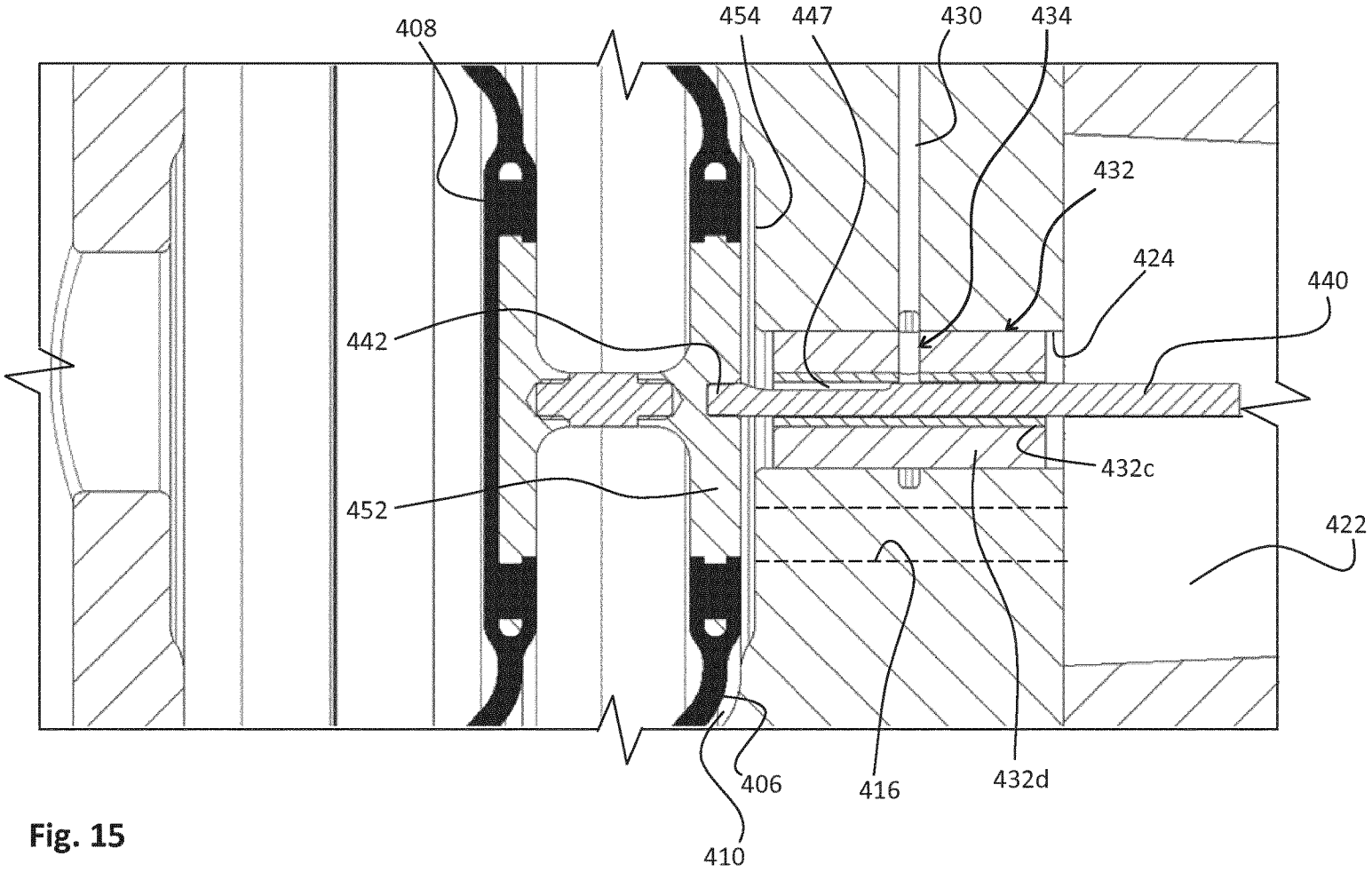
FIG. 15 shows a schematic, partial view of the third embodiment in a state where the membrane is at the first turning point.
Figure 22:
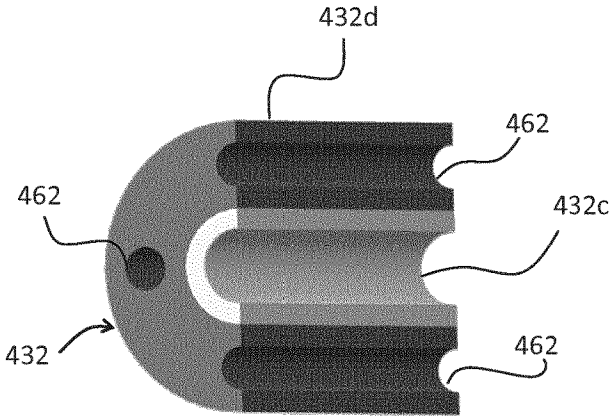
FIG. 22 shows a schematic, partial view of the bushing element according to the third embodiment.

In FIG. 15 this axle element 440 is shown in a state in which the membrane is at the first turning point, i.e. the first membrane 406 is positioned close to the rear wall 454. The bushing element 432 is in this embodiment different from the bushing elements described in the other embodiments. The bushing element 432 is here formed of two parts, an inner annular part 432*c* and an outer annular part 432*d*. The inner annular part 432*c* is preferably made of a ceramic material and the outer annular part 432*d* is preferably made of stainless steel. As can be seen in FIG. 22, showing a perspective cross section of a part of the bushing element 432, there are axial bushing channels 462 provided in the outer annular part 432*d*. These channels 462 are parallel to the axial opening extending between the first axial end 436 and the second axial end 438 (see FIG. 4) of the bushing element 432. These channels 462 will help transfer the low pressure to the fluid channel 430 when the membrane is at the first extreme point (see FIG. 16).

The outer diameter of the inner annular part 432*c* and the inner diameter of the outer annular part 432*d* are substantially the same. To assemble them the outer annular part 432*d* is heated such that its inner diameter is expanded slightly, whereby the outer annular part 432*d* can be mounted onto the inner annular part 432*c*. When the outer annular part 432*d* is cooled down the inner annular part 432*c* will be tightly fitted inside the outer annular part 432*d*. After that, the assembly is pressed into the passage 424 and achieves a tight fit. Both the inner and outer annular parts 432*c*, 432*d* have aligned radial openings 434. The bushing element 432 is slightly shorter in length than the passage 424, and is fitted centrally, with regard to the lengthwise direction, in the passage 424.

The axle element 440 is mounted such that the chamfered end of the recess 447 starts at or close to the reinforcement disc 452. Hence, at the first turning point, the recess is in fluid communication with the first membrane cavity portion 410. However, the recess 447 is not in fluid communication with the radial opening 434 of the bushing element 432.

Figure 16:
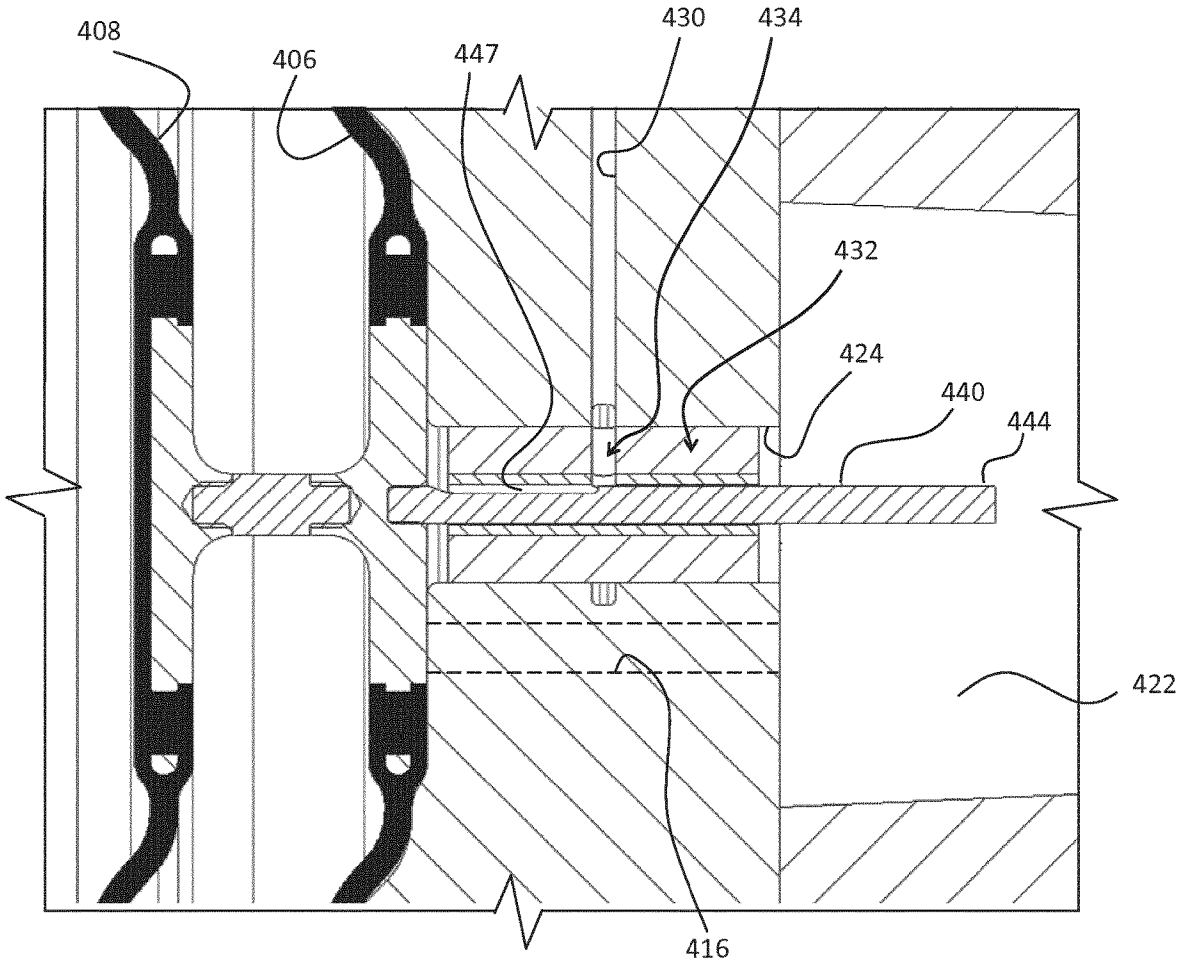
FIG. 16 shows a schematic, partial view of the third embodiment in a state where the membrane is at or near the first extreme point.

FIG. 16 shows a schematic, partial view of the third embodiment in a state where the membrane is at or near the first extreme point. It can be seen that a portion of the right end of the recess 447 is now overlapping the radial opening 434 of the bushing element 432, and hence the recess 447 is in fluid communication with the radial opening 434 of the bushing element 432. Since the radial opening 434 is in fluid communication with the hydraulic fluid reservoir 428 via the fluid channel 430, hydraulic fluid is able to pass into the first membrane cavity portion 410, such that the hydraulic fluid volume is again at its pre-defined volume.

Figure 17:
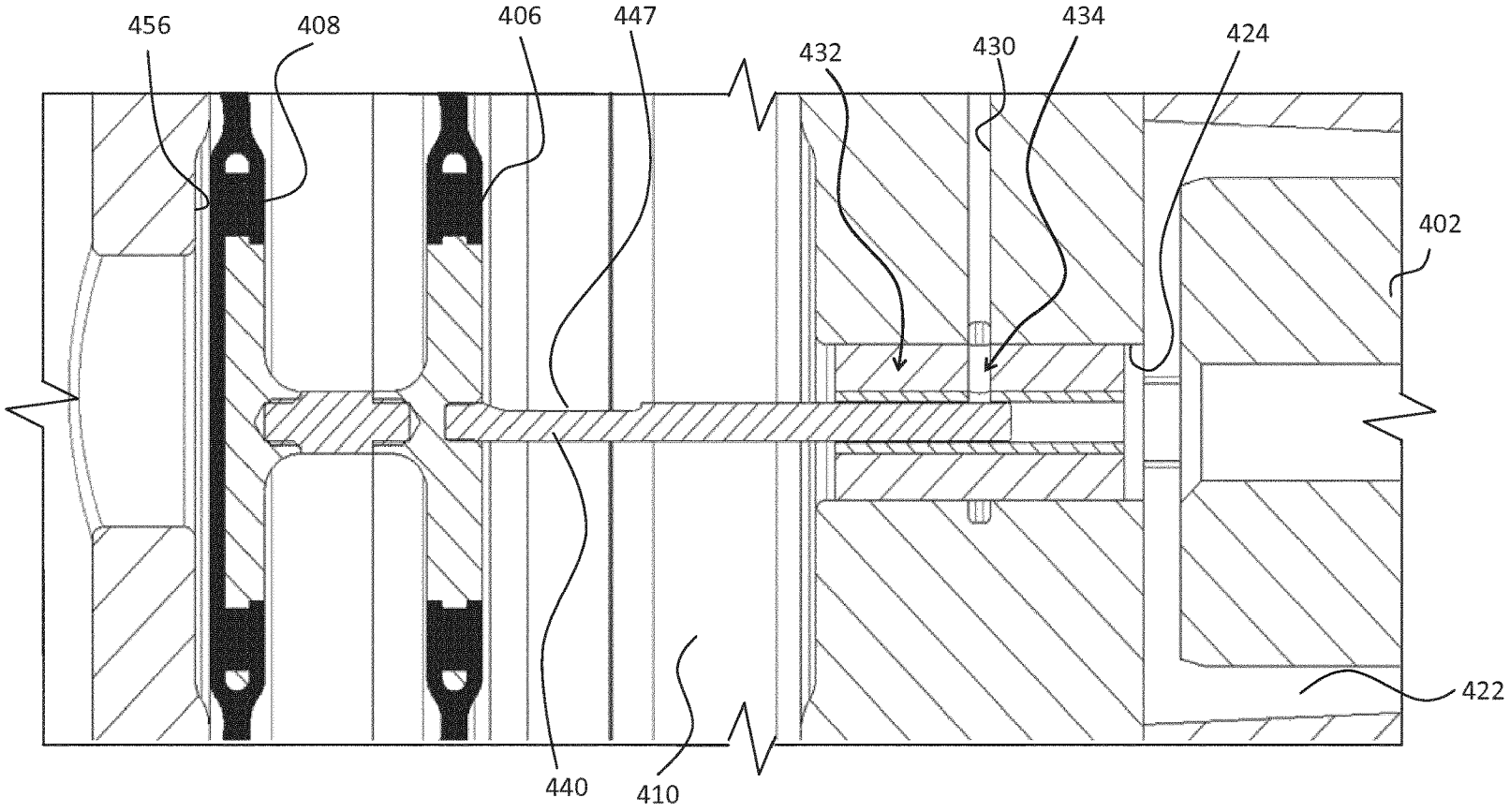
FIG. 17 shows a schematic, partial view of the third embodiment in a state where the membrane is at the second turning point.
Figure 18:
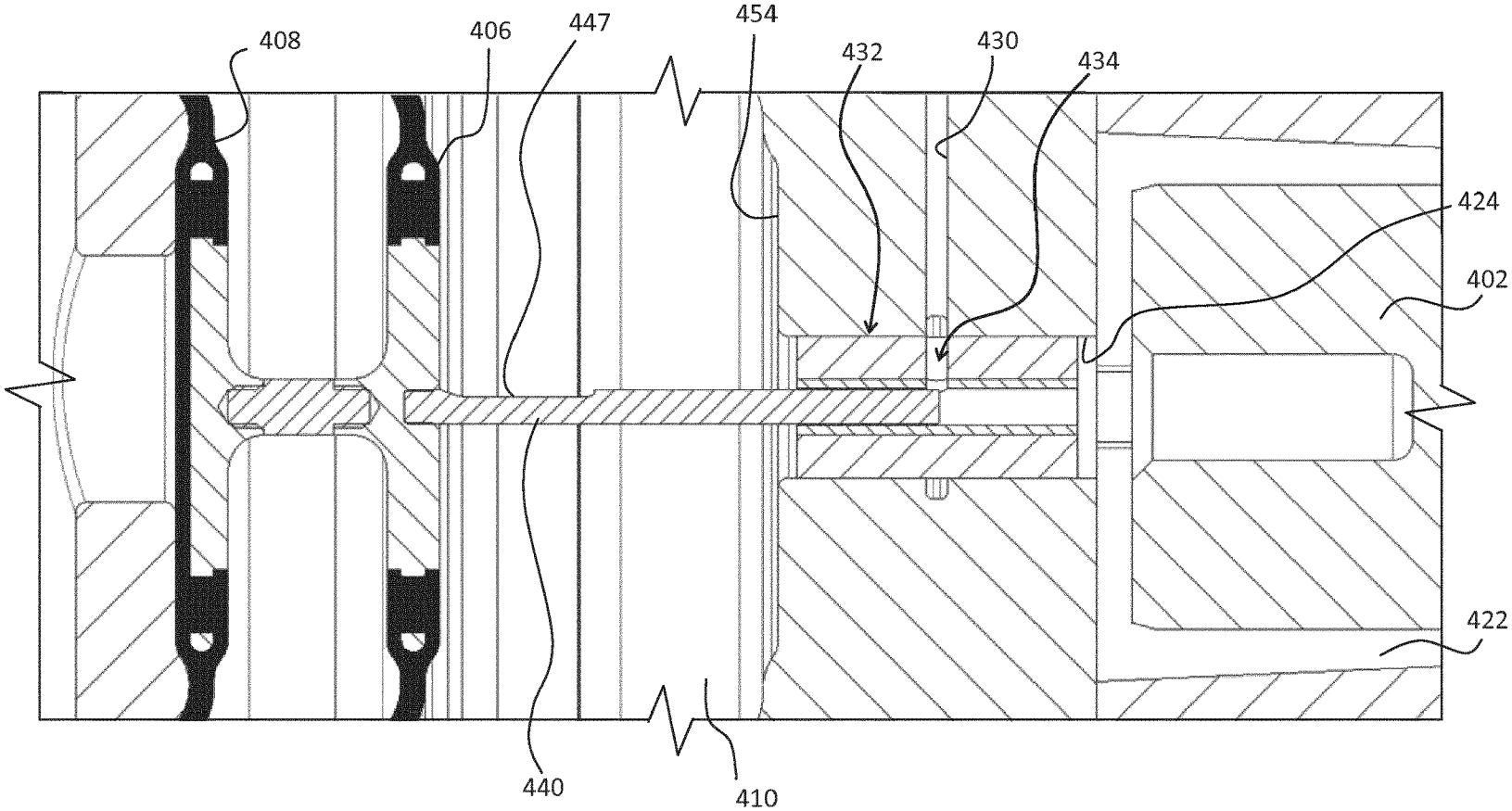
FIG. 18 shows a schematic, partial view of the third embodiment in a state where the membrane is near the second extreme point.

FIG. 17 shows the third embodiment in a state where the membrane is at the second turning point. The second membrane 408 is near the front wall 456. At this point the second end 444 of the axle element 440 is blocking the radial opening 434 of the bushing element 432, and there is basically no fluid communication between the radial opening 434 and the passage 424. FIG. 18 instead shows the state where the membrane is near the second extreme point. The second end 444 of the axle element 440 is now aligned with the centre of the radial opening 434 of the bushing element 432, and fluid communication is allowed between the fluid reservoir, via the fluid channel 430, and the piston cavity 422 (and thereby also the membrane cavity). Hydraulic fluid is discharged from the pump volume and flows back to the reservoir 428, such that the hydraulic fluid volume is again at its pre-defined volume.

Figure 19:
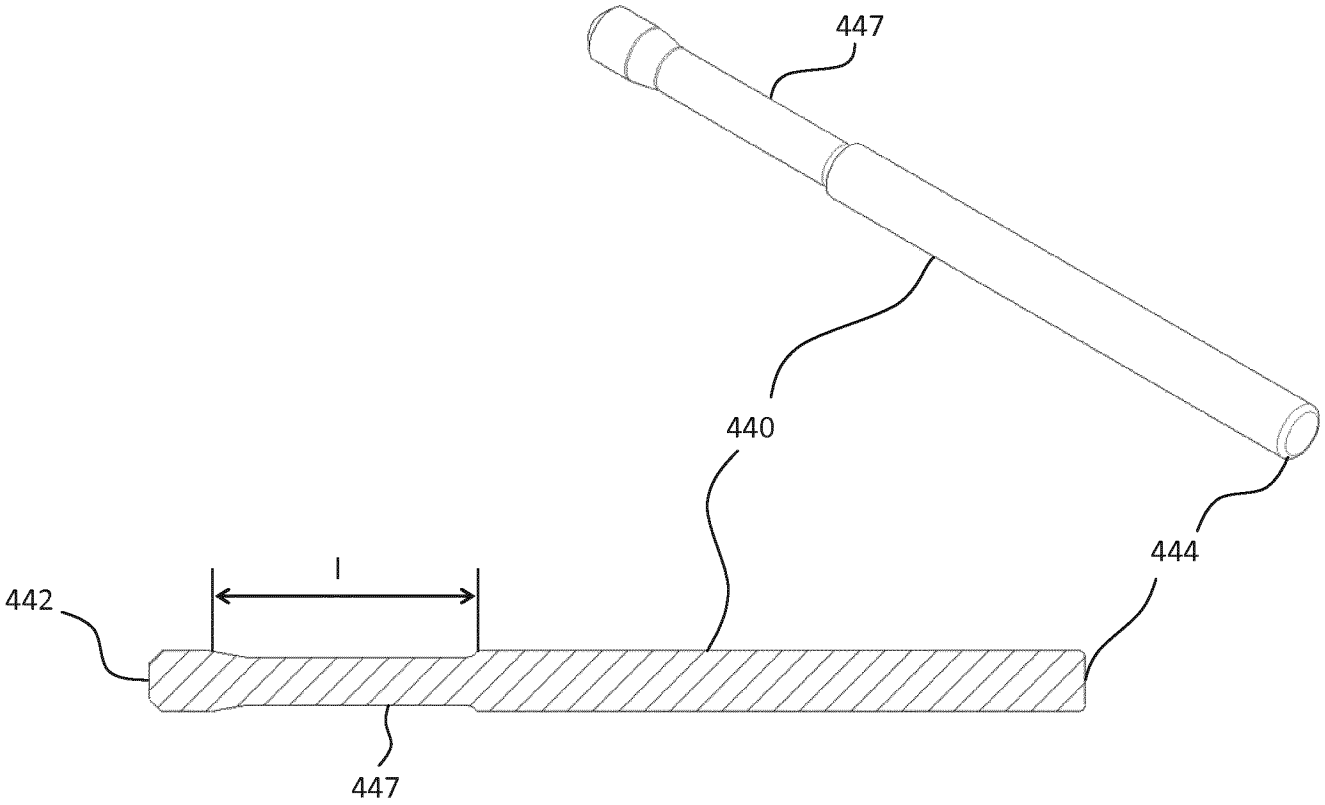
FIG. 19 shows a schematic perspective view and a schematic cross sectional view of the axle element of a fourth embodiment.

FIG. 19 shows a schematic perspective view and a schematic cross sectional view of an axle element of a fourth embodiment. The fourth embodiment is similar to the third embodiment except for the design of the recess 447 of the axle element 440. The axle element is solid, and has been turned, such as to form a circumferential groove around the perimeter of the axle element over a length 1. The position of this recess 447 is similar to that of the third embodiment. Hence the function of the third and fourth embodiments is similar. However, the assembling of the fourth embodiment is easier, since the axle element 440 can be mounted in the bushing element 432 without angular alignment between the recess 447 and the radial opening 434 of the bushing 432.

Figure 20:
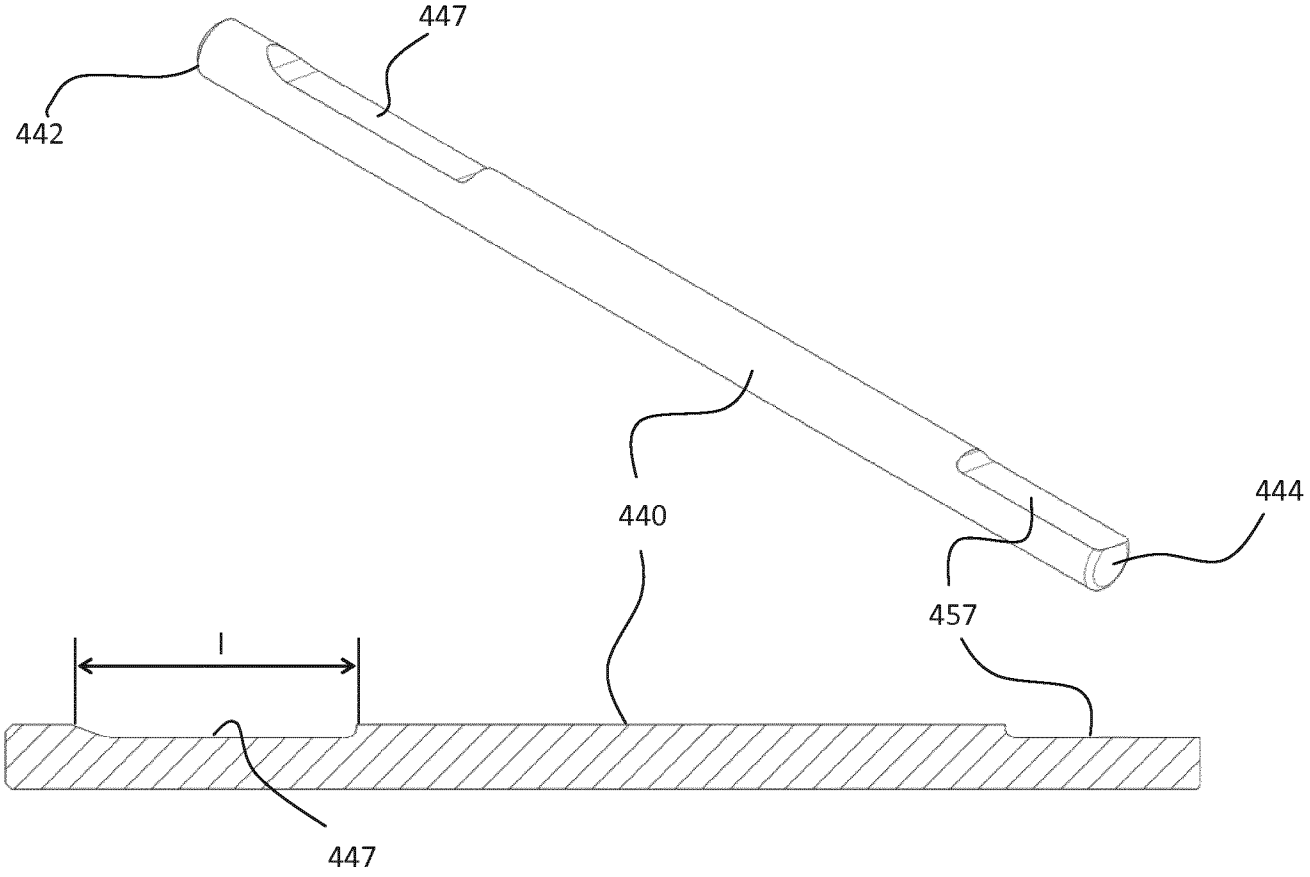
FIG. 20 shows a schematic perspective view and a schematic cross sectional view of an axle element of a fifth embodiment.
Figure 21:
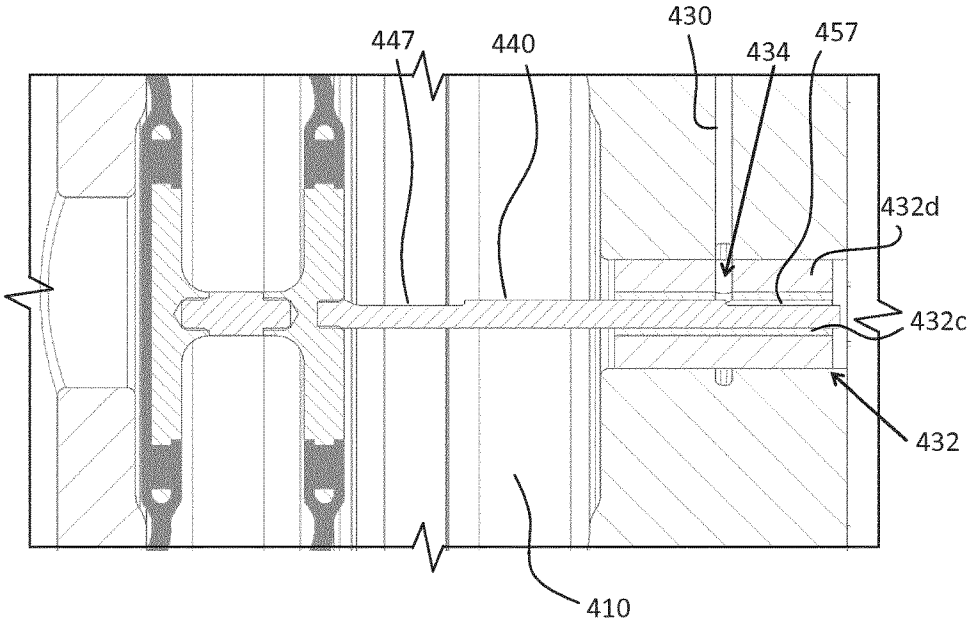
FIG. 21 shows a schematic, partial view of the fifth embodiment where the membrane is at a point near the second extreme point.

FIG. 20 shows two views of an axle element 440 according to a fifth embodiment. The axle element 440 has, in addition to the first recess 447, also a second recess 457, similar to the second recess 457 of the embodiment shown in FIG. 11. FIG. 21 shows the membranes in the second extreme point, and as can be seen the second recess 457 will provide fluid communication between the radial opening 434 of the bushing element 432 and the passage 424, and hence fluid communication between the hydraulic fluid reservoir and the membrane and piston cavities.

The high pressure membrane pump 400 of the invention may well be used in a homogenizer, for example the homogenizer marketed by Tetra Pak under the trade name Tetra Alex™, or any other conventional or future homogenizer.

Whilst the invention has been described with reference to preferred embodiments, it will be appreciated that various modifications are possible within the scope of the invention.

It has been shown that the hydraulic fluid reservoir, i.e. the tank, is arranged outside of the pump blocks. Alternatively, the hydraulic fluid reservoir may be integrated in one of the pump blocks, i.e. formed directly as a cavity in one of the blocks.

It has been described that the bushing element is tightly fit in the passage in the pump block. To further facilitate alignment of the axle element in the bushing, there may be provided elastic elements in between the bushing element and the passage, i.e. provided between the outer surface of the bushing element and the surface of the passage. The elastic elements are made of rubber. The elastic element makes it possible for the bushing element to make a slight radial adjustment and hence better align with the axle element, in case there is a slight misalignment between the two.

It has been described an axle element and a bushing having a circular cross section. Of course the shape may be another, for example squared.

Figure 13:
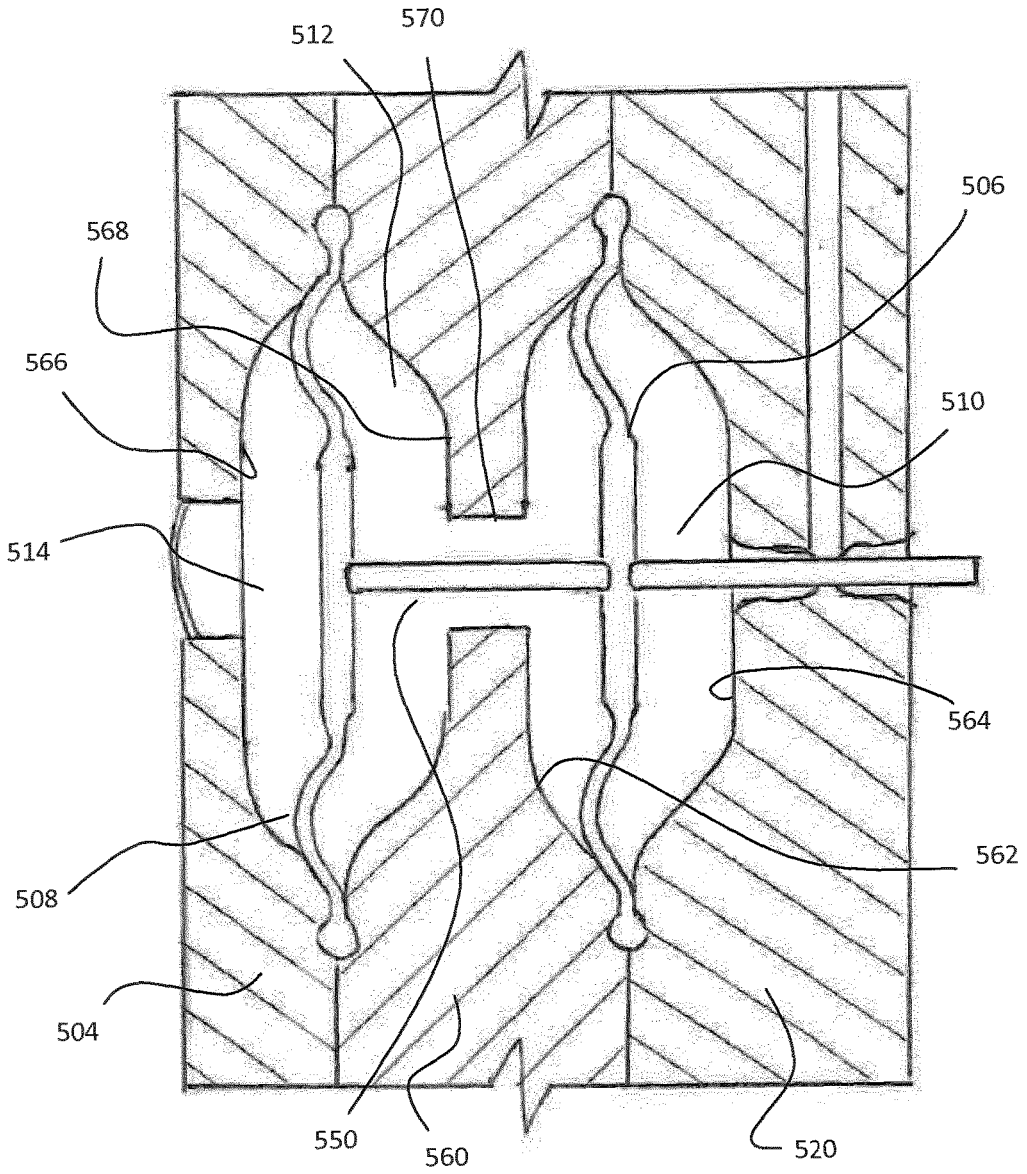
FIG. 13 shows a schematic view of an alternative membrane cavity.

The membranes are housed in one and same cavity. FIG. 13 shows an alternative membrane cavity. The pump housing comprises three pump blocks; a first pump block 504, a second pump block 520 and third, intermediate pump block 560. The membrane cavity is comprises a first membrane cavity portion 510, a second membrane cavity portion 514 and a membrane interior space 512. The first membrane 506 is arranged in the first membrane cavity portion 510, and the first membrane cavity portion 510 has a front wall 562 and a rear wall 564. The second membrane 508 is arranged in the second membrane cavity portion 514, and the second membrane cavity portion has a front wall 566 and a rear wall 568. The front walls 562, 566 are basically similar to the previously described front wall 456. Similarly, the rear wall 564, 568 are basically similar to the previously described rear wall 454. The membrane interior space 512 is formed in the third pump block and comprises an axial channel 570 through which the rod 550 extends.

The first and second embodiments may be combined. Hence, for example the bushing element of the second embodiment may be applied to the first embodiment. Further, for example, the axle element of the second embodiment may be applied to the first embodiment.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The pump being described in the embodiments have two membranes. However, it is to be understood that the pump may have more than two membranes, or have only one membrane.

The invention claimed is:

1. A membrane-based piston pump for pumping a liquid product, wherein said pump is provided with a device for maintaining a pre-defined hydraulic fluid volume in the pump, said device comprises: a hydraulic fluid reservoir, a bushing element attached in a passage between a piston cavity and a membrane cavity, said bushing element having a radial opening in fluid connection with the hydraulic fluid reservoir, an axle element arranged such that a first axial end thereof is attached to a first membrane provided in the membrane cavity, and such that at least a portion of said axle element is journalled, and adapted for axial movement, in the bushing element, said axle element being provided with a first recess proximate the first axial end and formed as a cut extending axially along an outer surface of the axle element, wherein if the first membrane is displaced beyond a first operational turning point, to a point at, or in close vicinity of, a first extreme point, the first recess of the axle element is in fluid connection with the radial opening of the bushing element and the membrane cavity, whereby the hydraulic fluid reservoir and the membrane cavity are fluidly connected, and if the first membrane is displaced beyond a second operational turning point, to a point between the second turning point and a second extreme point, a second axial end of the axle element is axially moveable away from a blocking position in which the second axial end blocks fluid communication between the radial opening and the piston cavity, and the radial opening of the bushing element is in fluid connection with the piston cavity, wherein fluid flows between the piston cavity and the hydraulic fluid reservoir past the second axial end, thereby forming a fluid connection between the hydraulic fluid reservoir and the hydraulic fluid volume of the pump.

2. The membrane-based piston pump according to claim 1, wherein the first operational turning point and the first extreme point are suction stroke points, and the connection between the first recess of the axle element and the radial opening of the bushing element, at or in the vicinity of, the first extreme point, will allow a flow of hydraulic fluid from the hydraulic fluid reservoir to the hydraulic fluid volume of the pump.

3. The membrane-based piston pump according to claim 1, wherein the second operational turning point and the second extreme point are pump stroke points, and the connection between the radial opening of the bushing element and the piston cavity, or the connection between the radial opening of the bushing element and the second recess of the axle element, at a point between the second operational turning point and the second extreme point, will allow a flow of hydraulic fluid from the hydraulic fluid volume of the pump to the hydraulic fluid reservoir.

4. The membrane-based piston pump according to claim 1, wherein a first axial end of the bushing element ends in the membrane cavity, and a second axial end of the bushing element ends in the piston cavity.

5. The membrane-based piston pump according to claim 1, wherein the first recess is a cut extending on an outer surface of the axle element, and which cut is adapted to provide fluid connection between the radial opening of the bushing element and the membrane cavity, at or in the vicinity of, the first extreme point.

6. The membrane-based piston pump according to claim 1, wherein the first axial end of the axle element is attached to a centrally arranged reinforcement disc attached to the first membrane.

7. The membrane-based piston pump according to claim 1, wherein the pump is adapted to increase the pump pressure from approximately 3 bar up to 250 bar and down to approximately 3 bar during the course of a pump stroke followed by a suction stroke.

8. The membrane-based piston pump according to claim 1, wherein the bushing element and the axle element are made of a ceramic material.

9. The membrane-based piston pump according to claim 8, wherein the ceramic material comprises zirconium oxide.

10. The membrane-based piston pump according to claim 1, wherein a gap between an outer envelope surface of the axle element and an inner envelope surface of the bushing element is in the range of 1-15 micrometers.

11. The membrane-based piston pump according to claim 1, wherein a second membrane is interconnected to the first membrane by means of a rod, said rod providing an axial distance between the first and the second membranes, and forming a membrane interior space.

12. The membrane-based piston pump according to claim 11, wherein the membranes and the membrane interior space divide the membrane cavity into at least first and second membrane cavity portions, said first and second membrane cavity portions being sealed from each other, said first membrane cavity portion being adapted to receive the hydraulic fluid, and said second membrane cavity portion being adapted to receive a liquid product.

13. The membrane-based piston pump according to claim 11, wherein the first and second membranes are coaxially arranged, the rod is arranged at the centres of the membranes, and the rod is axially aligned with the axle element.

14. The membrane-based piston pump according to claim 1, wherein one or more channels are provided between the membrane cavity and the piston cavity, the one or more channels being adapted for passage of hydraulic fluid.

15. A homogenizer comprising a membrane-based piston pump according to claim 1.

16. The membrane-based piston pump according to claim 1, wherein the axle element is solid.

17. The membrane-based piston pump according to claim 1, wherein the first recess has a first end that is chamfered and a second end opposite the first end that has a radius.

18. A method for pumping a liquid product in a pump, said pump comprising:

a hydraulic fluid reservoir, a bushing element attached in a passage between a piston cavity and a membrane cavity, said bushing element having a radial opening in fluid connection with the hydraulic fluid reservoir, an axle element arranged such that a first axial end thereof is attached to a first membrane provided in the membrane cavity, and such that at least a portion of said axle element is journalled, and adapted for axial movement, in the bushing element, said axle element being further provided with a first recess proximate the first axial end and formed as a cut extending axially along an outer surface of the axle element, wherein the method comprises the steps of filling a second membrane cavity portion, of the membrane cavity, with the liquid product by moving the first membrane to a first operational turning point, emptying the liquid product from the second membrane cavity portion by moving the first membrane to a second operational turning point, wherein the method further comprises the step of, if the first membrane is displaced beyond the first operational turning point, to a point at, or in close vicinity of, a first extreme point, creating a fluid connection between the hydraulic fluid reservoir and a hydraulic fluid volume of the pump for introducing hydraulic fluid into the pump by letting the first recess of the axle element come into fluid connection with the radial opening of the bushing element and the membrane cavity, whereby the hydraulic fluid reservoir and the membrane cavity are fluidly connected, and if the first membrane is displaced beyond a second operational turning point, to a point between the second operational turning point and a second extreme point, creating a fluid connection between the hydraulic fluid reservoir and the hydraulic fluid volume of the pump for discharging hydraulic fluid from the pump by a second axial end of the axle element axially moving away from a blocking position in which the second axial end blocks fluid communication between the radial opening and the piston cavity, and providing fluid connection between the radial opening of the bushing element and the piston cavity, wherein fluid flows between the piston cavity and the hydraulic fluid reservoir past the second axial end.

* * * * *